US011257382B2

(12) United States Patent
De Prins et al.

(10) Patent No.: US 11,257,382 B2
(45) Date of Patent: Feb. 22, 2022

(54) SYSTEM AND METHOD FOR OPTIMIZING A CRUISE VERTICAL PROFILE SUBJECT TO A TIME-OF-ARRIVAL CONSTRAINT

(71) Applicant: The Boeing Company, Chicago, IL (US)

(72) Inventors: Johan L. De Prins, Molenstede (BE); Bastian Figlar, Munich (DE); David Garrido-Lopez, Tres Cantos (ES); Julien Scharl, Bothell, WA (US); Thomas E. Yochum, Bothell, WA (US)

(73) Assignee: The Boeing Company, Chicago, IL (US)

( * ) Notice: Subject to any disclaimer, the term of this patent is extended or adjusted under 35 U.S.C. 154(b) by 374 days.

(21) Appl. No.: 16/202,431

(22) Filed: Nov. 28, 2018

(65) Prior Publication Data

US 2020/0168106 A1 May 28, 2020

(51) Int. Cl.
*G08G 5/00* (2006.01)

(52) U.S. Cl.
CPC ..... *G08G 5/0052* (2013.01); *G08G 5/003* (2013.01)

(58) Field of Classification Search
CPC .... G05B 13/042; G08G 5/0021; G08G 5/003; G08G 5/0034; G08G 5/0052
USPC ..... 701/3
See application file for complete search history.

(56) References Cited

U.S. PATENT DOCUMENTS 5,121,325 A * 6/1992 DeJonge ..... G05D 1/0005 244/182
8,744,768 B2 6/2014 Gutierez-Casteneda et al.
9,026,275 B1 * 5/2015 Young ..... G08G 5/0052 701/3
9,213,335 B2 12/2015 Garrido-Lopez
10,528,043 B2 * 1/2020 O'Laughlin ..... G08G 5/0021
2010/0114407 A1 * 5/2010 Klooster ..... G05D 1/0005 701/3
2014/0257598 A1 9/2014 Bailey et al.
2014/0343759 A1 * 11/2014 Garrido-Lopez .... G08G 5/0052 701/3

(Continued)

OTHER PUBLICATIONS

Extended European Search Report dated Apr. 6, 2020 in European Patent Application No. 19212261.2 (European counterpart to the instant U.S. Appl. No.).

*Primary Examiner* — Anshul Sood

(74) *Attorney, Agent, or Firm* — Ostrager Chong Flaherty & Broitman P.C.

(57) ABSTRACT

A system and a method for planning and flying a cost-optimal cruise vertical profile in combination with a required time-of-arrival (RTA) constraint. The method may be implemented as a single function in a flight management system (FMS). The FMS plans the aircraft trajectory with cruise vertical and speed profiles that are optimized to minimize flight cost (e.g., fuel burn) while meeting the time constraint. When appropriate under the circumstances, this integrated function is also able to degrade the cruise vertical profile in order to open the window of achievable RTAs and increase the RTA success rate. The method also monitors progress of the flight along the planned trajectory as actual flight conditions may differ from the forecasted flight conditions, and readapts the cruise speed profile when the estimated arrival time is deviating from the RTA constraint by more than a specified threshold.

16 Claims, 13 Drawing Sheets

(56) References Cited

U.S. PATENT DOCUMENTS

| | | | | |
|---|---|---|---|---|
| 2015/0277441 | A1* | 10/2015 | Garrido-Lopez | G08G 5/025 701/3 |
| 2016/0069688 | A1 | 3/2016 | Polansky et al. | |
| 2017/0249849 | A1 | 8/2017 | De Prins et al. | |
| 2018/0225979 | A1 | 8/2018 | Garrido | |
| 2019/0311634 | A1* | 10/2019 | Lax | G08G 5/0013 |
| 2019/0333394 | A1* | 10/2019 | Pastre | G05D 1/101 |

* cited by examiner

| FIG. 4A | |
|---|---|
| FIG. 4B | FIG. 4C |

| FIG. 6A | |
|---|---|
| FIG. 6B | FIG. 6C |

SYSTEM AND METHOD FOR OPTIMIZING A CRUISE VERTICAL PROFILE SUBJECT TO A TIME-OF-ARRIVAL CONSTRAINT

BACKGROUND

This disclosure generally relates to systems and methods for optimizing the cruise profile of an aircraft. The cruise profile for an aircraft includes a cruise speed profile indicating changes in speed along the planned flight path during the cruise phase and a cruise vertical profile indicating changes in altitude along the planned flight path during the cruise phase. In particular, this disclosure relates to systems and methods for optimizing the cruise vertical profile of an aircraft.

As used herein, the term "aircraft trajectory" means a four-dimensional (including time as the fourth dimension) flight path of an aircraft. An aircraft trajectory can be decomposed as follows:

(1) Its lateral path, which is (more or less) fixed by the flight management system (FMS) once the flight plan (succession of waypoints) is known to the FMS. The turn radius at waypoints with change in course depends (weakly) on speed and altitude, but does not change greatly.

(2) Its vertical profile or altitude as a function of distance-to-go, which depends on vertical constraints and steps introduced during the cruise phase, whether by manual or automatic cruise optimization. The vertical profile in climbs and descents also depends (more or less weakly) on scheduled speeds.

(3) Its speed schedule, which provides an airspeed at each point of the trajectory. The speed schedule may further depend on the vertical path, the lateral path, the weather conditions, the performance of the aircraft, including the varying weight, and the flight mode.

The result of all the foregoing, including the weather conditions, is a groundspeed value at every distance to a required time-of-arrival (RTA) waypoint, which may be integrated to give an estimated time-of-arrival (ETA).

A flight management system (FMS) accepts pilot-entered input data that represents a flight plan from the origin airport to the destination airport. A flight plan includes a sequence of waypoints that define the horizontal flight path. The initial cruise altitude is also specified. The FMS typically computes an optimized cruise vertical profile (referred to hereinafter as an "optimum vertical profile") that is defined as the altitude that minimizes cost (a combination of fuel cost and time cost, to be described below). The optimized altitude depends on aircraft gross weight, speed, wind and air temperature. However, the aircraft is usually constrained to fly at authorized (a.k.a. legal) altitudes in order to maintain traffic separation. The change from one legal altitude to another is referred to as a "step climb" or a "step descent". A step climb in aviation is a series of altitude gains that improve fuel economy by moving into less dense air as the gross weight of an aircraft decreases. In general, as fuel is burned off and the aircraft loses weight, the optimized cruise altitude (the altitude that minimizes cost of flight) increases. For long flights, points at which to initiate a step climb to a new cruise altitude are also specified.

The planned speed schedule of a flight operation is determined by the FMS based on the desired cruise mode chosen by the airline/flight crew. A typical mode is economy (ECON) mode which determines the most economic speed based on a cost index (CI), chosen by the airline, driven by a specific trade-off between cost of time and cost of fuel. The instantaneous cost per unit distance can be written as $$\text{Cost (lb/NM)} = (\text{Fuel Flow (lb/hr)} + 100 * \text{CI}) / \text{Ground-speed (kts)}$$

where the cost index CI is the ratio between operational costs and fuel costs that is deemed to be optimum by the airline for that particular flight. The cost index is usually introduced by the pilots using a control display unit (CDU) of the FMS as a constant before the aircraft takes off. Alternative cruise modes are long-range cruise (LRC) or selected speed mode (SEL).

In combination with the speed scheduling modes, some flight management systems also offer a cruise vertical profile optimization function (referred to hereinafter as "cruise optimization") to plan steps (climb/descent) for cruise flight conditions that minimize trip cost or trip fuel (depending on the active flight mode listed above) as conditions change during cruise, that is, favorable wind and temperatures aloft vary with altitude and location and optimized aircraft performance changes as aircraft weight decreases. The flight management computer (FMC) is programmed to optimize the cruise vertical profile by determining an optimum down-path three-dimensional location (latitude, longitude and altitude) at which a step climb or step descent will be initiated. One example of a cruise optimization is shown in FIG. 1, wherein three climb steps are planned over a 6000-NM cruise for an initial aircraft weight of 600,000 lbs, CI=0, and realistic winds, resulting in a savings of at least 5000 lbs of fuel for this particular flight.

The flight crew can still introduce cruise steps manually into the flight plan, in which case the function will calculate additional steps only beyond the latest manual step. Cruise optimization is active in the FMS from the moment when a flight plan is activated on the ground until the end of cruise and will periodically recalculate the optimized vertical profile for the remainder of the cruise phase.

An alternative speed scheduling mode available on some flight management systems is the required time-of-arrival (RTA) function, which determines a new speed profile to meet a time constraint at a down-path waypoint. This mode is used whenever a flight is requested to adhere to a RTA constraint requested by Air Traffic Control (ATC) or defined by the airline operations center. Once the RTA function is activated, the economic optimum desired by the airline is ignored and the cost of the flight will increase.

The RTA speed mode can be combined with cruise optimization. However, in such a combination the respective modes interfere with each other. In some flight management systems, the last active optimized step climb profile is fixed and no further cruise optimization is performed, although the planned cruise speed may change significantly during RTA operation. This approach is taken to avoid oscillation of the optimum step locations as the RTA speed profile is changed.

Some flight management systems treat the RTA and cruise optimization problem mostly as separate functionalities, where the FMS gives preference to the RTA speed profile generation over the cruise optimization. One known FMS seeks to optimize the vertical profile in a sequence of climb steps, taking into account wind, temperature, and weight variations. This function also may alter the cruise vertical profile when an RTA becomes active, in which case the FMS tries to approximate an optimum step climb profile, but always giving preference to the RTA objective. In any case, this functionality performs cruise optimizations locally (step climb benefit evaluated only over next 250-500 NM) instead of globally (step climb benefit evaluated over the full trajectory). Additionally, this function does not consider the vertical degree of freedom (e.g., planned cruise vertical profile) as a mechanism to open the solution space/window of achievable RTAs.

SUMMARY

The subject matter disclosed in some detail below is directed to a system and a method for planning and flying a cost-optimum cruise vertical profile in combination with a required time-of-arrival (RTA) constraint. The method may be implemented as a single function in a flight management system (FMS). The FMS plans the aircraft trajectory with cruise vertical and speed profiles that are optimized to minimize flight cost (e.g., fuel burn) while meeting the time constraint. When appropriate under the circumstances, this integrated function is also able to degrade the cruise vertical profile in order to open the window of achievable RTAs and increase the RTA success rate. The method also monitors progress of the flight along the planned trajectory as actual flight conditions may differ from the forecasted flight conditions, and readapts the cruise speed profile when the estimated arrival time is deviating from the RTA constraint by more than a specified threshold.

The method proposed herein provides a robust solution that integrates the cruise optimization function and the RTA function of the FMS in order to meet the time constraint while saving trip fuel by flying at more economic altitude/speed combinations. The proposed method uses the vertical degree of freedom to increase the window of achievable RTAs and increase the chance of RTA success. Simulations demonstrated that the fuel cost of the RTA operation may be reduced by 1% to 10% while continuing to optimize the vertical profile during RTA for a typical cruise range.

In accordance with some embodiments, the cruise optimization and RTA functions may be integrated in an optimization module that forms one part of the internal configuration of a flight management computer (FMC). Some of the functional units described in this specification have been labeled as modules in order to more particularly emphasize their implementation independence. For example, a module may be implemented as a hardware circuit comprising integrated circuits or gate arrays, off-the-shelf semiconductors such as logic chips, transistors, or other discrete components. A module may also be implemented in programmable hardware devices such as field-programmable gate arrays, programmable array logic, programmable logic devices or the like. Modules may also be implemented in software for execution by various types of processors. An identified module of computer-readable program code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Although various embodiments of systems and methods for planning and flying a cost-optimal cruise vertical profile in combination with a RTA constraint will be described in some detail below, one or more of those embodiments may be characterized by one or more of the following aspects.

One aspect of the subject matter disclosed in detail below is a method for flying an aircraft along a trajectory subject to time-of-arrival constraints during a cruise phase, the method comprising: (a) determining an optimum trajectory that includes a speed schedule that meets a required time-of-arrival at a waypoint and a vertical profile that optimizes fuel efficiency; and (b) flying the aircraft along the optimum trajectory during the cruise phase, wherein step (a) is an integrated function executed by a computer, the integrated function consisting of a required time-of-arrival functionality and a cruise optimization. Step (a) is performed only if an RTA speed mode and cruise optimization are both active and either the vertical profile of the optimum trajectory would significantly improve the fuel efficiency or the required time-of-arrival is unachievable.

In accordance with some embodiments of the method described in the immediately preceding paragraph, step (a) comprises: estimating a first cost index ($CI_{RTA,est}$) for a required time-of-arrival; determining an optimum vertical profile for the first cost index; calculating an estimated time-of-arrival window for the optimum vertical profile using a maximum cost index and a minimum cost index; determining whether the required time-of-arrival is outside of the estimated time-of-arrival window or not; if the required time-of-arrival is not outside of the estimated time-of-arrival window, performing a search iteration on the cost index involving a trajectory prediction comprising the optimum vertical profile for the first cost index, resulting in a second cost index ($CI_{RTA}$) that produces an estimated time-of-arrival that meets the required time-of-arrival for flight along the optimum vertical profile; and calculating the optimum trajectory based on the second cost index.

Another aspect of the subject matter disclosed in detail below is a system for flying an aircraft along a trajectory subject to time-of-arrival constraints during a cruise phase, the system comprising a computer system configured to perform the following operations: (a) determining an optimum trajectory that includes a speed schedule that meets a required time-of-arrival at a waypoint and a vertical profile that optimizes fuel efficiency; and (b) controlling the aircraft to fly along the optimum trajectory during the cruise phase, wherein operation (a) is an integrated function executed by the computer system, and the integrated function consists of a required time-of-arrival functionality and a cruise optimization.

A further aspect of the subject matter disclosed in detail below is a method for flying an aircraft along a trajectory subject to time-of-arrival constraints during a cruise phase, the method comprising: (a) determining a first optimum vertical profile for a maximum cost index; (b) calculating a first estimated time-of-arrival for the first optimum vertical profile; (c) determining a second optimum vertical profile for a minimum cost index; (d) calculating a second estimated time-of-arrival for the second optimum vertical profile; (e) determining whether a required time-of-arrival is outside of an estimated time-of-arrival window bounded by the first and second estimated times-of-arrival or not; (f) if the required time-of-arrival is outside of the estimated time-of-arrival window, determining a degraded optimum trajectory that includes a speed schedule that meets a required time-of-arrival at a waypoint and a degraded vertical profile that improves fuel efficiency; and (g) flying the aircraft along the degraded optimum trajectory during the cruise phase, wherein step (f) is an integrated function executed by a computer, the integrated function consisting of a required time-of-arrival functionality and a cruise optimization.

In accordance with some embodiments of the method described in the immediately preceding paragraph, step (f) comprises: determining a degraded optimum vertical profile for a maximum or minimum cost index; calculating an estimated time-of-arrival window for the degraded optimum vertical profile using a maximum cost index and a minimum cost index; determining whether the required time-of-arrival is outside of the estimated time-of-arrival window or not; if the required time-of-arrival is not outside of the estimated time-of-arrival window, performing a search iteration on the cost index involving a trajectory prediction comprising the optimum vertical profile for the first cost index, resulting in a cost index ($CI_{RTA}$) that meets the required time-of-arrival for flight along the degraded optimum vertical profile; and calculating the degraded optimum trajectory based on the cost index.

Yet another aspect of subject matter disclosed in detail below is a system for flying an aircraft along a trajectory subject to time-of-arrival constraints during a cruise phase, the system comprising a computer system configured to perform the following operations: (a) determining a first optimum vertical profile for a maximum cost index; (b) calculating a first estimated time-of-arrival for the first optimum vertical profile; (c) determining a second optimum vertical profile for a minimum cost index; (d) calculating a second estimated time-of-arrival for the second optimum vertical profile; (e) determining whether a required time-of-arrival is outside of an estimated time-of-arrival window bounded by the first and second estimated times-of-arrival or not; (f) if the required time-of-arrival is outside of the estimated time-of-arrival window, determining a degraded optimum trajectory that includes a speed schedule that meets a required time-of-arrival at a waypoint and a degraded optimum vertical profile that improves fuel efficiency; and (g) if the required time-of-arrival is outside of the estimated time-of-arrival window, controlling the aircraft to fly along the degraded optimum trajectory during the cruise phase, wherein the computer system comprises a first computer configured to perform operations (a) through (f), and operation (f) is an integrated function consisting of a required time-of-arrival functionality and a cruise optimization and a second computer configured to control the aircraft to fly in accordance with the degraded optimum vertical profile and the second cost index.

Other aspects of systems and methods for planning and flying a cost-optimal cruise vertical profile in combination with a RTA constraint are disclosed below.

BRIEF DESCRIPTION OF THE DRAWINGS

The features, functions and advantages discussed in the preceding section may be achieved independently in various embodiments or may be combined in yet other embodiments. Various embodiments will be hereinafter described with reference to drawings for the purpose of illustrating the above-described and other aspects. None of the diagrams briefly described in this section are drawn to scale.

Reference will hereinafter be made to the drawings in which similar elements in different drawings bear the same reference numerals.

DETAILED DESCRIPTION

Illustrative embodiments of systems and methods for planning and flying a cost-optimal cruise vertical profile in combination with an RTA constraint are described in some detail below. However, not all features of an actual implementation are described in this specification. A person skilled in the art will appreciate that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

A flight management system (FMS) onboard an aircraft is a specialized computer system that automates a wide variety of in-flight tasks. A primary function of a FMS is in-flight management of the flight plan. Using various sensors to determine the aircraft's position and an autopilot system, the FMS can guide the aircraft in accordance with the flight plan. Typically an FMS comprises a navigation database that contains the elements from which the flight plan is constructed. Given the flight plan and the aircraft's position, the FMS calculates the course to follow. The pilot can follow this course manually or the autopilot can be set to follow the course.

The flight plan includes a vertical trajectory, a lateral trajectory, time, and a speed schedule to be followed by the aircraft with respective tolerances, enabling the aircraft to reach its destination. The calculations of the flight plans are based on the characteristics of the aircraft, on the data supplied by the crew and on the environment of the system. The positioning and guidance functions then collaborate in order to enable the aircraft to remain on the trajectories defined by the FMS. The trajectories to be followed are constructed from a succession of "waypoints" associated with various flight points, such as altitude, speed, time, modes, heading, and other points. The term "waypoint" encompasses any point of interest where the point is defined using two, three or four dimensions. A trajectory is constructed from a sequence of segments and curves linking the waypoints in pairs from the departure point to the destination point. A segment or series of segments may be constrained by one or more economic constraints (e.g., time, fuel, and/or cost or a combination thereof). The speed schedule represents the speed and speed mode that the aircraft should maintain over time as it flies along the flight trajectory.

Figure 1:
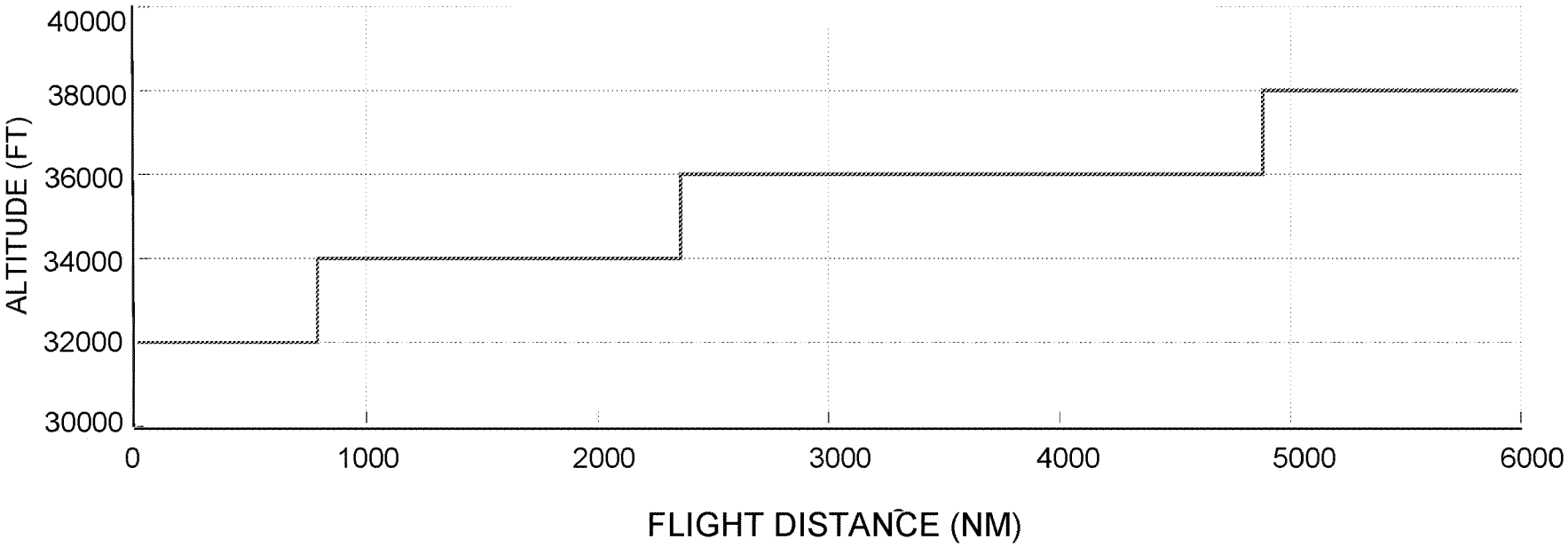
FIG. 1 is a graph showing altitude versus flight distance for one example of a cruise vertical profile that has been optimized in a sequence of climb steps.
Figure 2:
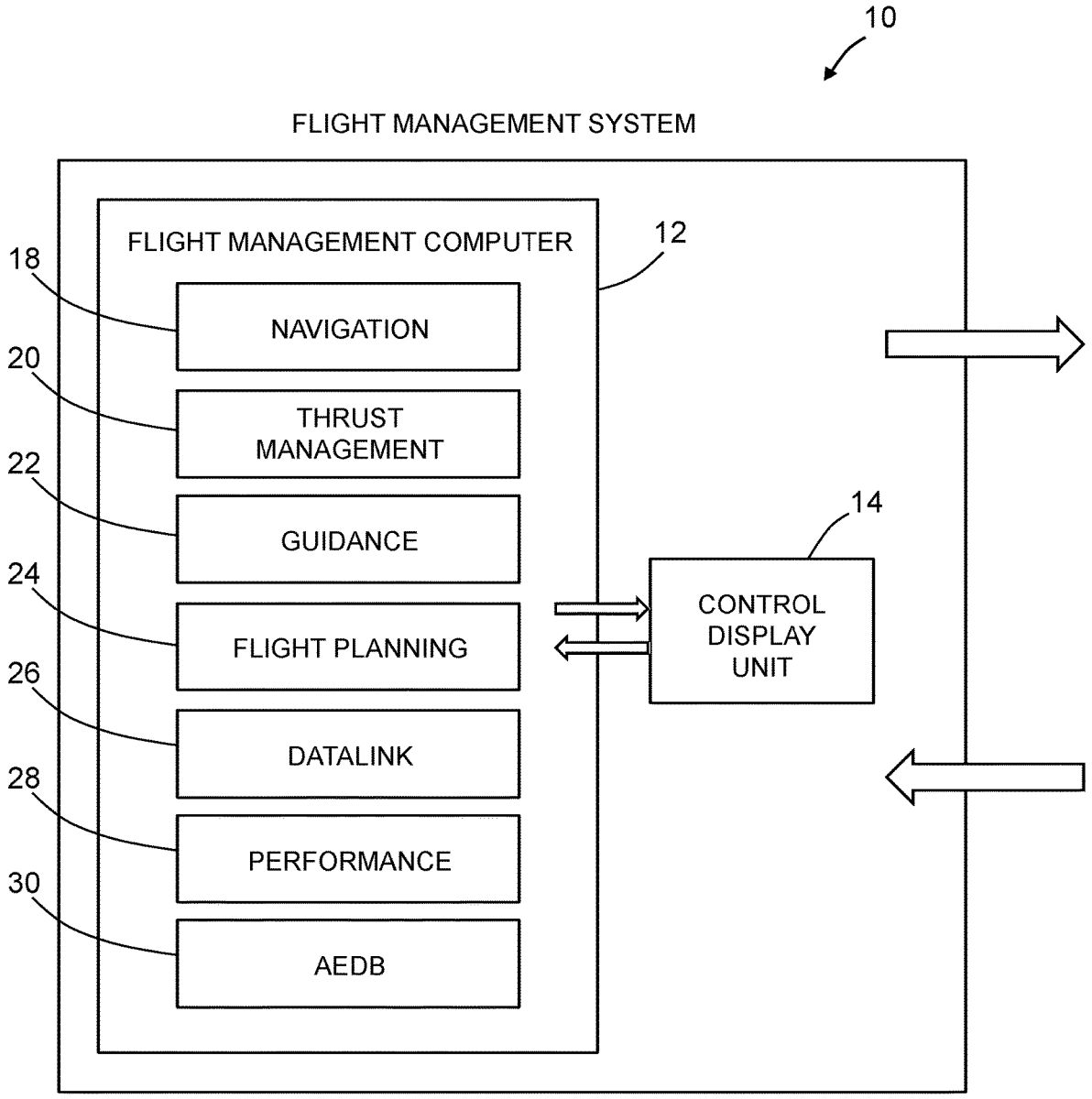
FIG. 2 is a block diagram showing an overall architecture of a typical flight management system.

FIG. 2 is a block diagram showing an overall architecture of a typical flight management system 10 of a type comprising one or more flight management computers 12 and one or more control display units 14. Only one flight management computer 12 (hereinafter "FMC 12") and one control display unit 14 (hereinafter "CDU 14) are depicted in FIG. 2. The CDUs are the primary interface between the FMCs and the pilots.

The FMC software may reside on respective core processors in respective airplane information management system cabinets. The FMC software may comprise the following: a flight management function, a navigation function 18, a thrust management function 20, and a baseline performance database 30 (for example, an aero/engine database containing aerodynamic and propulsion data). The flight management function provides guidance 22, flight planning 24, datalink 26, a performance management function 28, CDU interfaces, an interface to the baseline performance database 30, and other functionalities. The navigation function provides sensor selection (inertial, radio, satellite), position solution determination and other functionalities. The navigation function computes airplane position, velocity, track angle and other airplane parameters, collectively termed airplane states, to support FMC functions such as flight planning, guidance, and display.

The flight management system 10 integrates information from an air data and inertial reference system, navigation sensors, engine and fuel sensors, and other airplane systems (not shown in FIG. 2), along with internal databases and crew-entered data to perform the multiple functions. The flight management computer may contain a navigation database (not shown in FIG. 2) and the baseline performance database 30.

For the performance management function 28, the flight management system 10 has various internal algorithms that utilize aerodynamic and propulsion performance data stored in the baseline performance database 30 to compute predicted flight profile and the associated trip prediction parameters such as estimated time-of-arrival and predicted fuel consumption quantity. The performance management function 28 uses aerodynamic and propulsion models and optimization algorithms to generate a full flight regime vertical profile consistent with the performance mode selected and within flight plan constraints imposed by air traffic control. Inputs to the performance management function 28 include fuel flow, total fuel, flap position, engine data and limits, altitude, airspeed, Mach number, air temperature, vertical speed, progress along the flight path and pilot inputs from the CDU 14. The outputs are target values of Mach number, calibrated airspeed and thrust for optimized control of the airplane, and advisory data to the crew.

Various performance modes for each flight phase, such as economy climb, economy cruise and long-range cruise, may be selected by the pilot through the CDU 14. Multiple performance modes may be specified for the cruise flight phase. The default mode is an economy profile with speed limited. Economy profiles are computed to optimize fuel or time costs as governed by a cost index factor.

The aerodynamic and propulsion models are used to generate an optimized vertical profile for the selected performance modes. If the autothrottle or autopilot is not engaged for automatic control of the performance management function 28, the pilot can manually fly the optimized speed schedule by referring to the CDU 14 and to the airspeed bug on the speed tape.

The baseline performance database 30 contains prestored data for the aerodynamic model of the airplane as well as for the engine performance model and thrust rating model of the engines. The baseline performance database 30 is used by the performance management function 28 to compute real-time parameters such as speed limits and speed targets, and to perform predictive computations such as flight plan predictions. The baseline performance database 30 is also used by the thrust management function 20 to compute thrust limits.

In some cases, the flight planning function 24 may be performed by a flight planning module in the FMC 12 that includes a flight plan/route processor. The flight plan/route processor uses data retrieved from a navigation database to convert (e.g., by decoding and translation) flight plan/route information into a flight plan/route comprising a list of waypoints and associated flight information. The elements of the decoded and translated flight plan/route are stored in fields of a flight object (along with aircraft type and equipage), where they are available for use by the flight plan/route processor and a flight trajectory predictor (also part of the flight planning module). The flight object may reside in a separate processor that manages the flight object.

In accordance with some embodiments, the flight trajectory predictor (which is also a processor) receives the flight object containing a list of waypoints making up a flight plan/route from the flight plan/route processor and then calculates an updated predicted flight trajectory based on that flight plan/route, an original flight trajectory (if available), the aircraft type and how it is equipped, current and/or forecast environmental conditions retrieved from an environmental database, and other information. The trajectory prediction process can start at any point in any phase of flight, and modifies its process methods/components as appropriate to the available aircraft state and flight information. After the application of environmental data, the trajectory predictions are recalculated. The output of the flight trajectory predictor is the predicted trajectory that includes a vertical profile. The predicted trajectory is stored in the flight object. The pilot or autopilot may then fly the aircraft by following the predicted trajectory as closely as possible.

Figure 3:
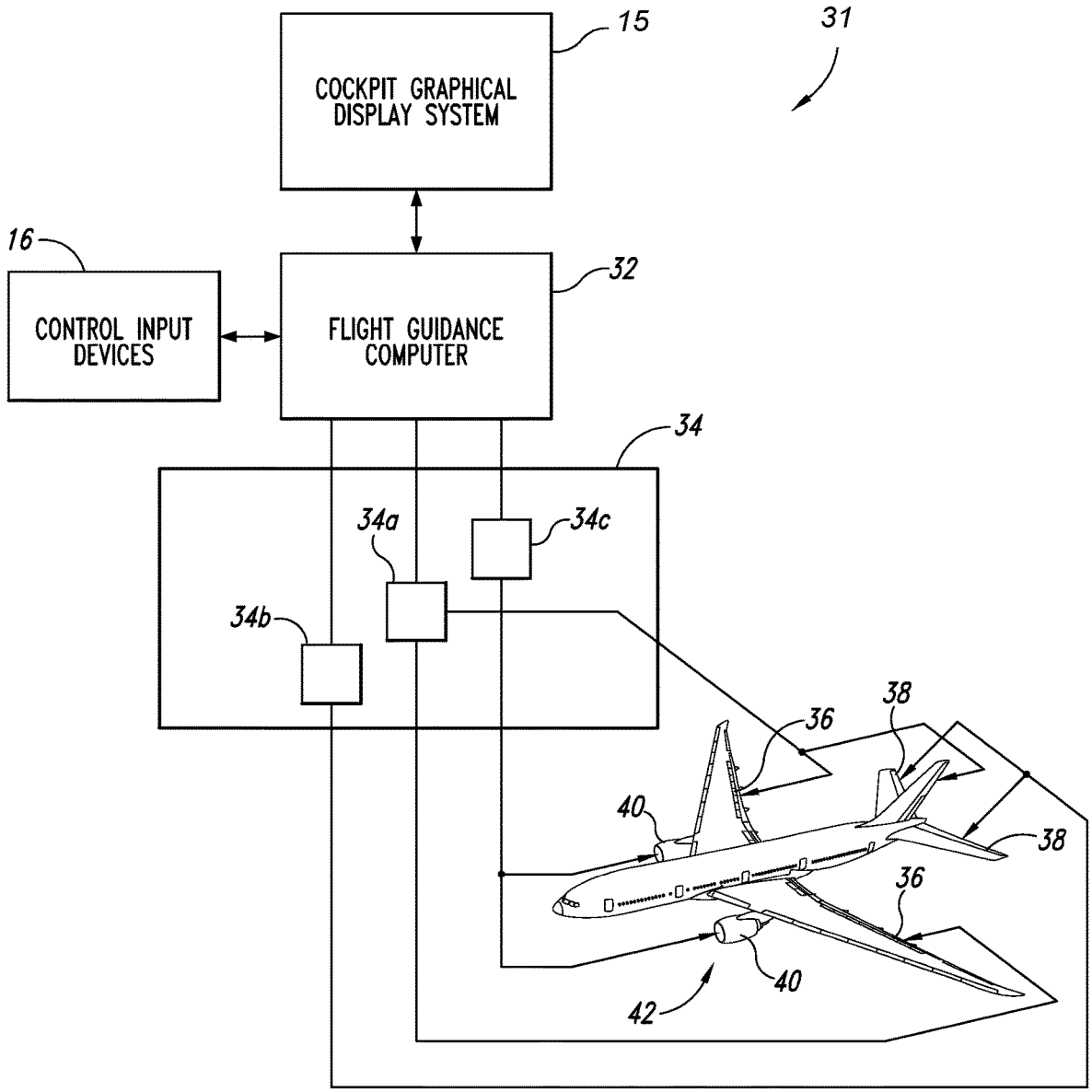
FIG. 3 is a diagram showing an aircraft flight control architecture including a plurality of control systems.

An aircraft's flight control system provides the capability to stabilize and control the aircraft. Two key elements of a flight control system are the flight guidance system that generates guidance commands and the auto-pilot that executes them. As shown in FIG. 3, a flight guidance system 31 includes display devices such as a cockpit graphical display system 15 or other annunciators (not shown), control input devices 16, a flight guidance computer 32, and a plurality of control systems 34. The flight guidance computer 32 and control systems 34 may be components of an aircraft flight control system that communicates with the flight management computer 12 shown in FIG. 2. In one example, the plurality of control systems 34 include a lateral/directional motion (or roll/yaw) control system 34*a*, a vertical motion (or pitch) control system 34*b*, and an airspeed (or autothrottle/engine) control system 34*c*. The lateral/directional control system 34*a* can be coupled to flight control surfaces 36 affecting lateral and directional control, which are typically ailerons and/or rudders of the aircraft 42. The vertical motion control system 34*b* can be coupled to pitch control surfaces 38, which are typically the aircraft's elevators. Lastly, the airspeed control system 34*c* can be coupled to the engines 40 of the aircraft 42 in some path-based modes of operation, and can be coupled to the elevators in some climb and descent modes of operation.

The enhanced technology disclosed herein includes a method for planning and flying a cost-optimal cruise vertical profile in combination with a required time-of-arrival (RTA) constraint. The method may be implemented as a single integrated vertical profile optimization/RTA function in the FMC 12. The FMC 12 is configured (e.g., programmed) to plan or predict the aircraft cruise trajectory with vertical and speed profiles that minimize flight cost (e.g., fuel burn) while meeting the RTA constraint. When appropriate under the circumstances, the integrated function is also configured to degrade the cruise vertical profile in order to open the window of achievable RTAs and increase the RTA success rate. The method also monitors progress of the flight along the planned trajectory as actual flight conditions may differ from the forecasted flight conditions, and readapts the cruise speed profile when the estimated arrival time is deviating from the RTA constraint by more than a specified threshold.

The full integration of the RTA functionality and the optimized cruise step-climb functionality in a single function of the flight management system (which includes FMC 12) has the following advantages:

(1) Unlike the case of segregated algorithms, the method proposed herein is capable of finding a trajectory that meets the RTA with optimized fuel efficiency by flying a globally optimum or near-optimum cruise vertical profile.

(2) Additionally, the integrated flight management functionality disclosed herein allows for altering the optimum vertical profile in case the RTA is not achievable along that vertical profile. In such cases, the proposed integrated flight management functionality is configured to gradually degrade the fuel-optimal vertical profile until the RTA becomes achievable. This method offers significant fuel savings with respect to an easy-to-implement, conservative approach of switching to a constant-flight-level (constant-altitude) cruise profile.

The proposed methodology takes a two-step approach: (1) perform a coarse search for an optimal cruise profile/cost index combination that approximately delivers the flight near the RTA constraint; and (2) then perform a fine search by tuning only the cruise cost index (with fixed vertical profile) to improve the RTA delivery accuracy. The method disclosed in some detail hereinafter is effective because flight time is more sensitive to vertical profile changes than to airspeed (cost index) changes, while the optimum vertical profile is less sensitive to changes in airspeed (cost index).

Figures 4, 4A:
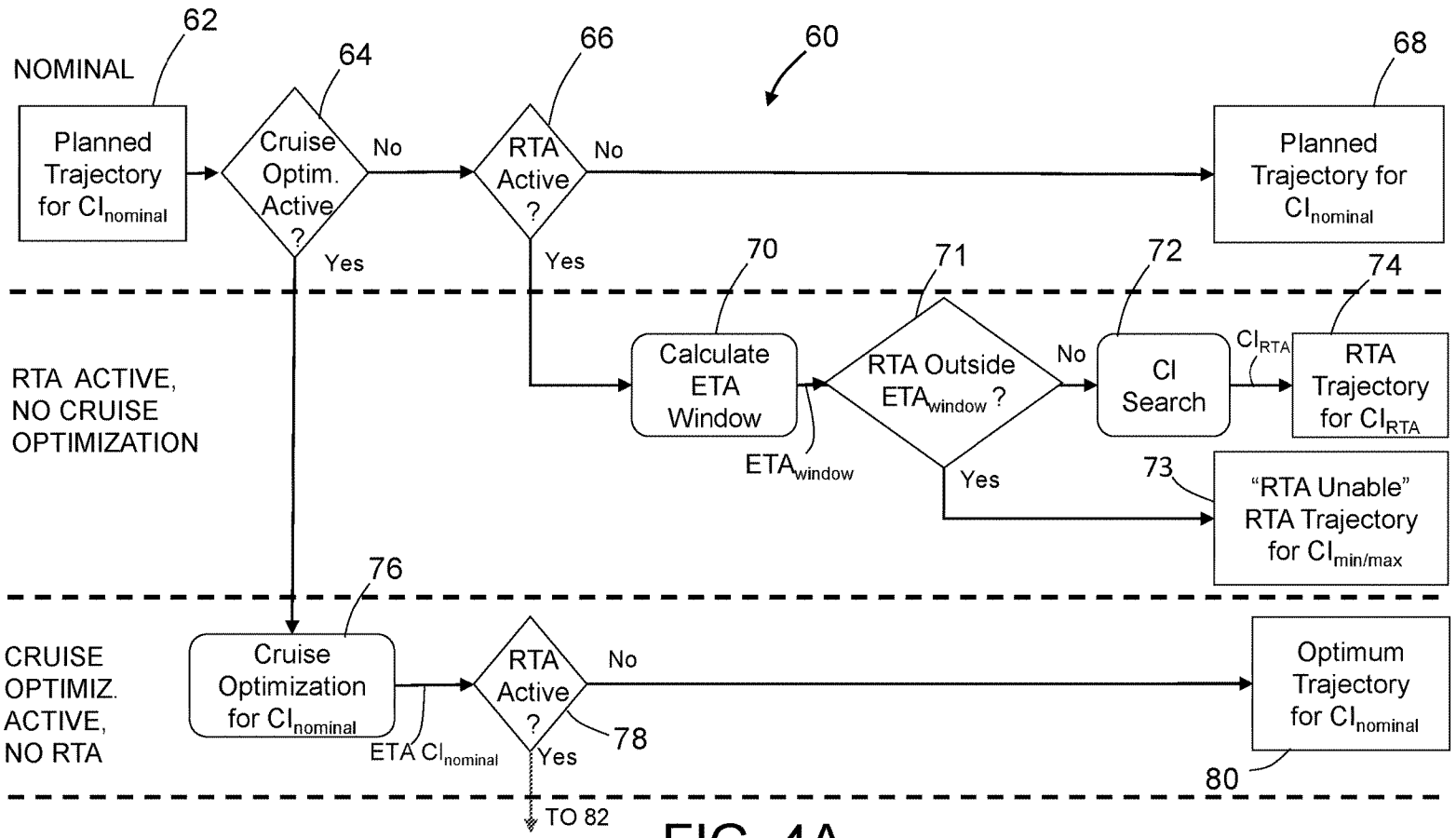
FIG. 4 is a diagram indicating the relationships between FIGS. 4A, 4B and 4C, which appear on separate pages. Viewed in conjunction, FIGS. 4A-4C form a flowchart showing the logic of an algorithm for an initial determination of an RTA trajectory with cruise optimization following engagement of the integrated FMS function proposed herein.
Figures 6, 6A:
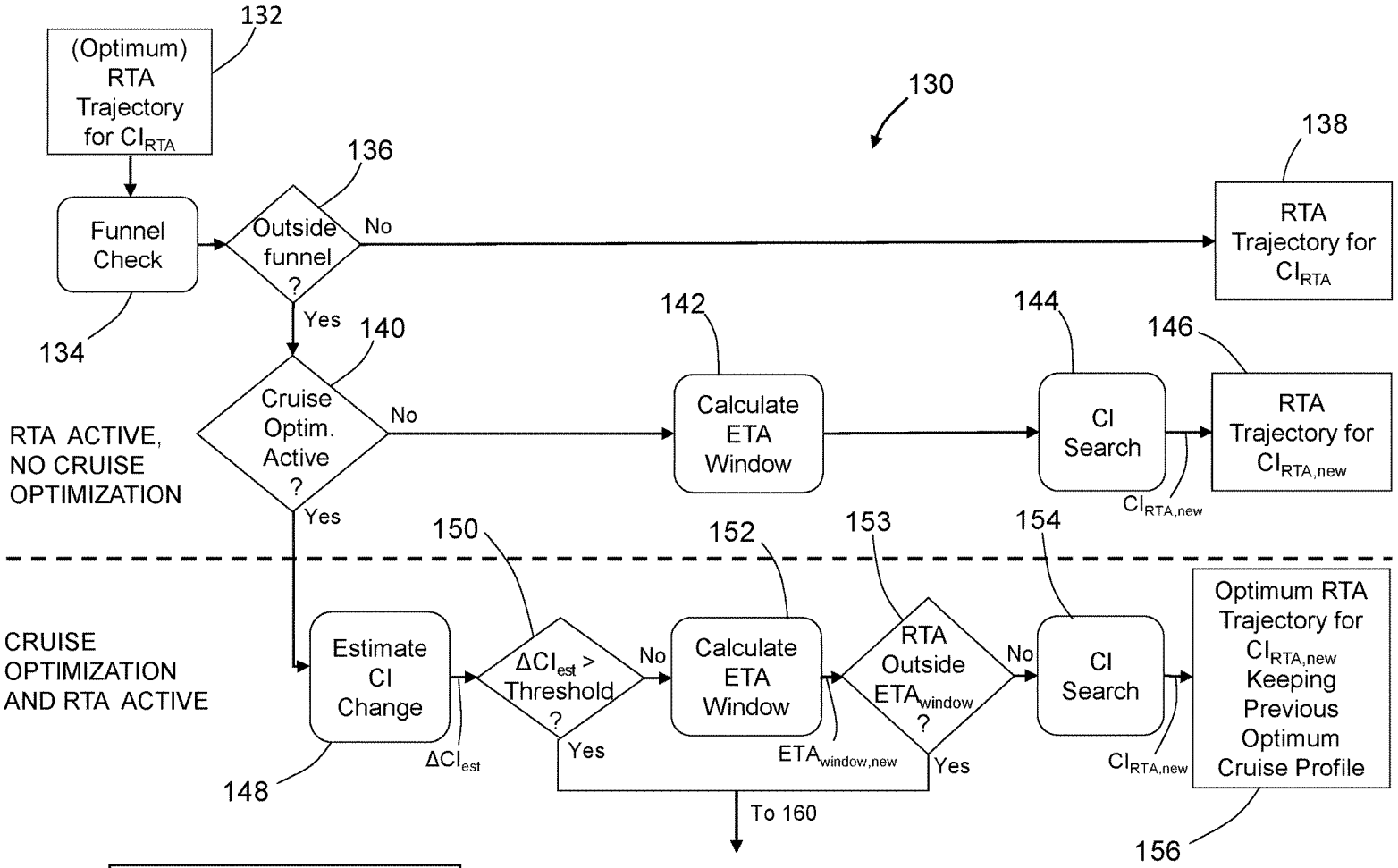
FIG. 6 is a diagram indicating the relationships between FIGS. 6A, 6B and 6C, which appear on separate pages. Viewed in conjunction, FIGS. 6A-6C form a flowchart showing the logic of an algorithm for monitoring the RTA trajectory with cruise optimization while the integrated FMS function proposed herein is active.

A more detailed description of two proposed methods for planning and flying a cost-optimal cruise vertical profile in combination with a RTA constraint will now be provided with reference to FIGS. 4 and 6 respectively. A distinction is made herein between an initial (first) RTA trajectory determination when the RTA function is engaged (a method represented by the flowchart shown in FIGS. 4A-4C) and a subsequent (second) RTA trajectory change that may be needed while RTA performance is being monitored (a method represented by the flowchart shown in FIGS. 6A-6C). For the purpose of illustration, the flowcharts assume that by default, optimization of the cruise vertical profile (hereinafter "cruise optimization") is active in the FMC 12. The methodologies proposed herein combine cruise optimization and RTA determination to achieve a jointly optimized altitude versus time solution. Optionally, cruise optimization functionality can be suppressed or may not have been purchased by the airline. The flowcharts represent an implementation for an FMS that has the option of cruise optimization being inactive.

Figure 4B:
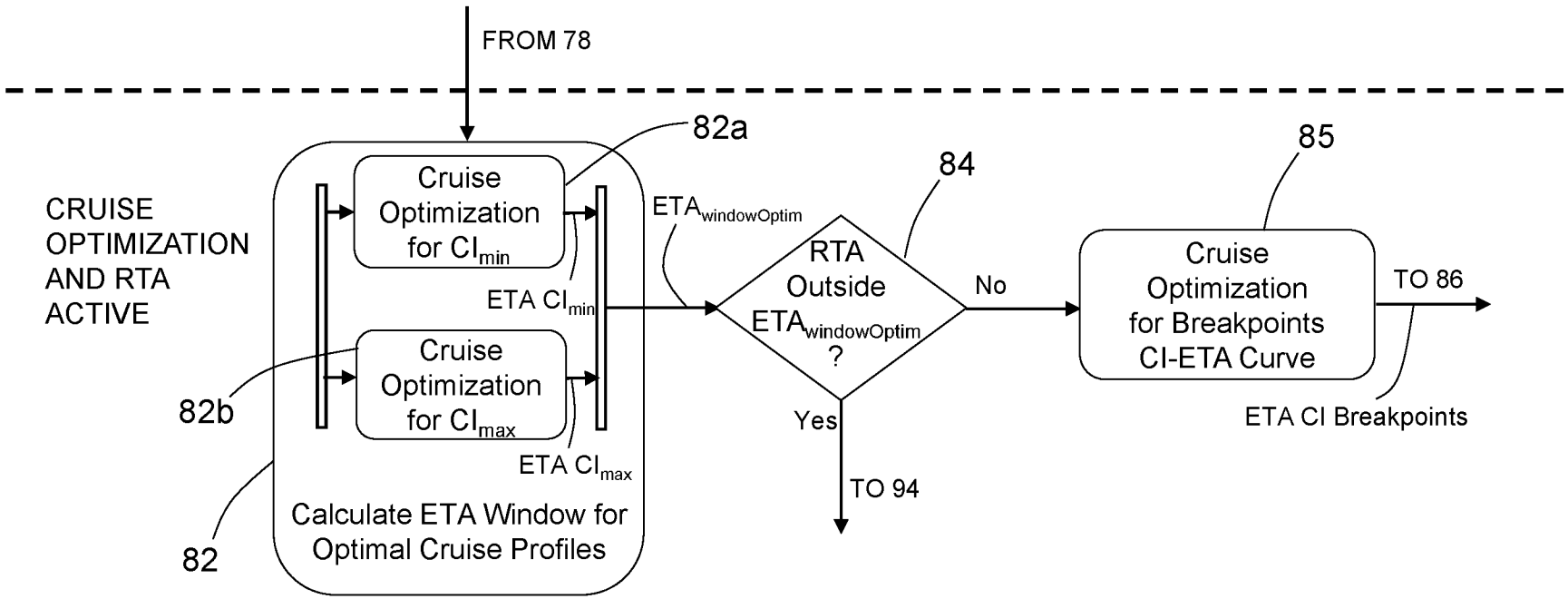
Figure 4C:
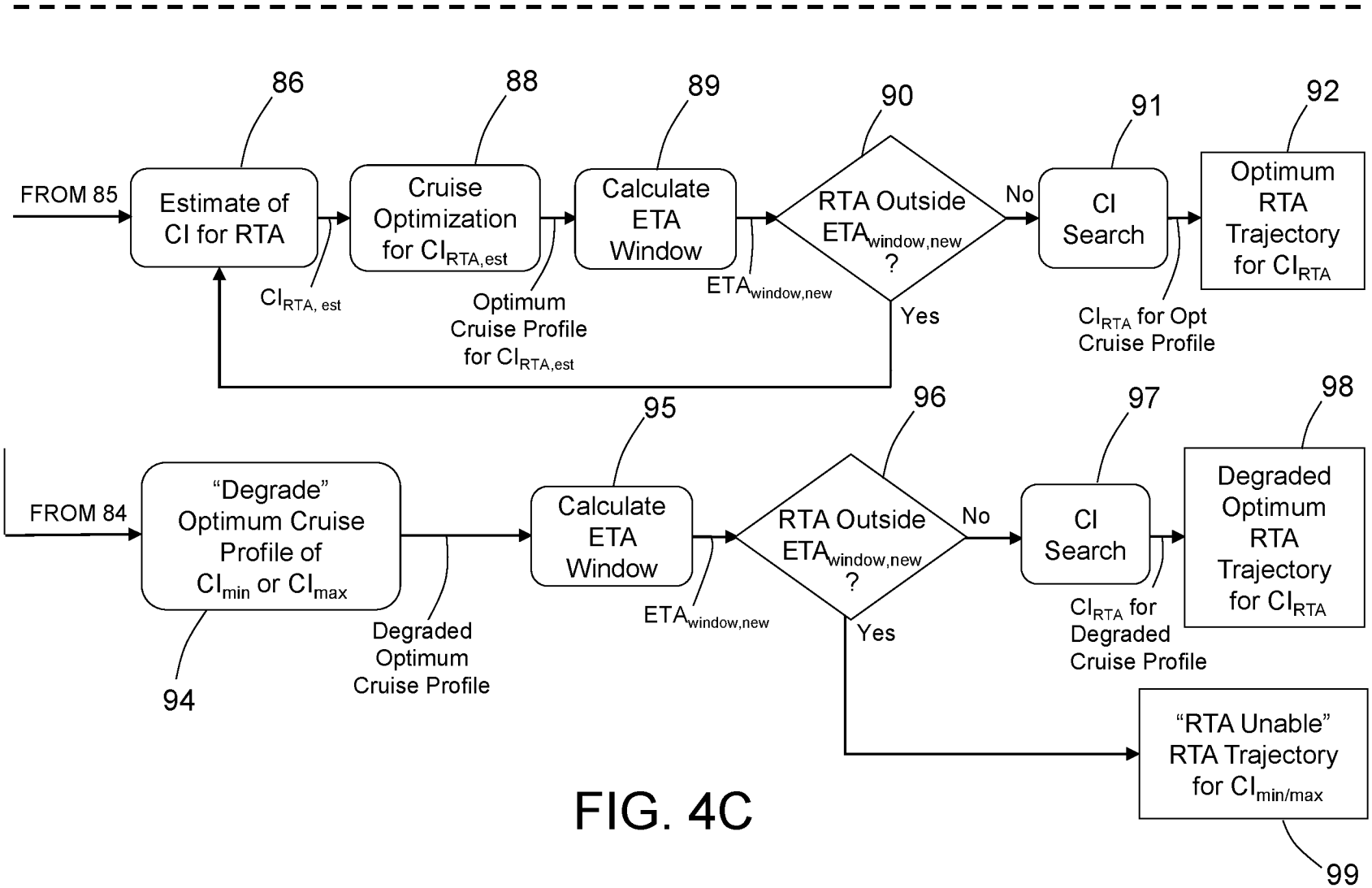

Viewed in conjunction, FIGS. 4A-4C form a flowchart showing the logic of an algorithm 60 for making an initial determination of an RTA trajectory with cruise optimization following initiation by the FMC 12 of the integrated functionality proposed herein. As used herein, the term "RTA trajectory" means a trajectory which is predicted to arrive at a specified waypoint at an associated RTA. As used herein, the term "lookup table" refers to an array of data that maps input values to output values, thereby approximating a mathematical function. Given an input value, a "lookup" operation retrieves the corresponding output value from the table. If the lookup table does not explicitly define the input values, appropriate software can be employed to estimate an output value using interpolation, extrapolation, or rounding. As used herein, the term "breakpoint data set" means a vector of input values that indexes a particular dimension of a lookup table. A lookup table uses breakpoint data sets to relate its input values to the output values that it returns. As used here, the term "breakpoint" means a single element of a breakpoint data set. A breakpoint represents a particular input value to which a corresponding output value in the table data is mapped.

Referring to FIG. 4A, the FMC 12 is configured (e.g., programmed) to initially manage a planned trajectory in accordance with a nominal cost index ($CI_{nominal}$) (Step 62). The FMC 12 is further configured to make a determination whether the cruise optimization function is active or not (step 64). If a determination is made in step 64 that the cruise optimization function is not active, then the FMC 12 determines whether the RTA speed mode is active or not (step 66). If a determination is made in step 66 that the RTA speed mode is not active, then the FMC 12 maintains the planned trajectory for the nominal cost index $CI_{nominal}$ (step 68).

If a determination is made in step 66 that the RTA speed mode is active (RTA active, no cruise optimization), then the FMC 12 computes the window of achievable estimated times of arrival ($ETA_{window}$) (step 70). In the next step 71, the FMC 12 determines whether the RTA is outside the ETA window (meaning that the RTA is not achievable). If a determination is made in step 71 that the RTA is not outside the ETA window, the FMC 12 performs a search iteration on the cost index involving the trajectory prediction. In accordance with one embodiment, a Regula Falsi search algorithm may be used for iterating on the cost index to converge to the precise cost index $CI_{RTA}$ to meet the RTA at a down-path waypoint along the current flight path (step 72). In accordance with one implementation, a Regula Falsi algorithm with Illinois variant (an algorithm similar to the root-finding Newton or Secant method) is used to perform the cost index search. In mathematics, the Regula Falsi algorithm is a method for solving an equation in one unknown. In simple terms, the method is the trial and error technique of using test ("false") values for the variable and then adjusting the test value according to the outcome. Other mathematical optimization algorithms may be used. The FMC 12 then calculates the RTA trajectory in accordance with the cost index $CI_{RTA}$ (step 74). If a determination is made in step 71 that the RTA is outside the ETA window, the fastest or slowest trajectory is selected and an "RTA Unable" message will be generated by the FMC 12 (step 73).

If a determination is made in step 64 that the cruise optimization function is active, then the FMC 12 operates in accordance with an ECON speed mode in which the cruise vertical profile is optimized based on the nominal cost index $CI_{nominal}$ set by the flight crew (step 76). This calculation is the same as done periodically for the cruise vertical profile optimization with the RTA speed mode inactive. Then the FMC 12 determines whether the RTA speed mode is active or not (step 78). If a determination is made in step 78 that the RTA speed mode is not active, then an optimized trajectory is recomputed for current flight conditions in accordance with the nominal cost index $CI_{nominal}$ (step 80).

If a determination is made in step 78 (see FIG. 4A) that the RTA speed mode is active, then the FMC 12 calculates the window of achievable ETAs for a set of optimum vertical profiles (step 82) as depicted in FIG. 4B. This ETA window is calculated considering the slowest and fastest trajectories, both optimized vertically for their respective minimum and maximum cost indexes $CI_{max}$ and $CI_{min}$ (steps 82*a* and 82*b* respectively). More specifically, the ETA window $ETA_{windowOptim}$ is defined by one ETA corresponding to $CI_{max}$ (hereinafter "ETA $CI_{max}$") and another ETA corresponding to $CI_{min}$ (hereinafter "ETA $CI_{max}$"). The FMC 12 then uses the window $ETA_{windowOptim}$ to determine whether the RTA is outside of the window $ETA_{windowOptim}$ (meaning that the RTA is out of the reach of an optimized cruise trajectory) or not (step 84). Note that minimizing the cost here will end up being equivalent to minimizing fuel, since flight time is constrained by the RTA.

The $CI_{max}$ and $CI_{min}$ parameters are pre-specified in the baseline performance database 30 (see FIG. 2) of the airplane model, together with the cost index versus airspeed lookup tables. This data may be constructed based on test flight data and the cost index formula disclosed herein. $CI_{max}$ and $CI_{min}$ are limits imposed to the cost index, which depend on the aircraft model. ($CI_{max}$ and $CI_{min}$ are not absolute constants for a given aircraft model. Depending on the flight conditions such as altitude, weight, winds, etc., the limits for the cost index may also vary. However, the greatest influence on the CI limits is the aircraft model, particularly its size.) The $CI_{max}$ and $CI_{min}$ parameters reflect the cases of "fuel is no concern, fly as fast as possible" and "minimize fuel burn". These minima/maxima are manifested as minimum or maximum operating speeds. As the cost index is reduced, the airspeed is reduced; as the cost index is increased, the airspeed increases as well. $CI_{max}$ and $CI_{min}$ are pre-computed for the given aircraft model and used in a manner that, when they are selected, they provide an airspeed close to the minimum flyable airspeed and maximum flyable airspeed, respectively, for the current conditions (weight, altitude, atmosphere, wind).

Referring again to FIG. 4B, the FMC 12 is further configured to then determine the cruise vertical profile for the RTA operation, with near-optimal fuel cost to the extent possible. If a determination is made in step 84 that the RTA is not outside of the window $ETA_{windowOptim}$ (the RTA is achievable), the FMC 12 seeks an optimum vertical profile for the RTA trajectory. Estimation of the CI for the RTA is based on a linear lookup table of CI versus ETA. The number of breakpoints in the lookup table includes at least the limit values $CI_{min}$ and $CI_{max}$ for the ETA window and the nominal cost index $CI_{nominal}$, and can be extended with any number of predefined cost indexes to better capture the shape of the CI versus ETA curve. Cruise optimization is performed for the additional cost index breakpoints and the ETAs for the addition CI breakpoints are calculated in step 85.

Following step 85, the algorithm 60 proceeds to step 86 depicted in FIG. 4C. The FMC 12 first calculates an initial best estimate of the RTA cost index $CI_{RTA,est}$ (step 86 in FIG. 4C). Experiments demonstrated that a good initial estimate of cost index to be used in the RTA operation can be calculated through linear interpolation using the following equation:

$$CI_{RTA,est}=CI_{max}-(RTA-ETA_{fast})\times(CI_{max}-CI_{min})/(ETA_{slow}-ETA_{fast}) \quad (1)$$

where $CI_{max}$ is the maximum cost index considered for the RTA, based on performance limitations; $ETA_{fast}$ is the earliest ETA possible along the optimum vertical profile for $CI_{max}$; $CI_{min}$ is the minimum cost index considered for the RTA, based on performance limitations; and $ETA_{slow}$ is the latest ETA possible along the optimum vertical profile for $CI_{min}$. The resulting estimated cost index $CI_{RTA,est}$ is not accurate enough to be used for the RTA trajectory directly, but it is sufficiently close to determine the optimum vertical profile for an RTA operation with near-optimal cost.

Figure 5:
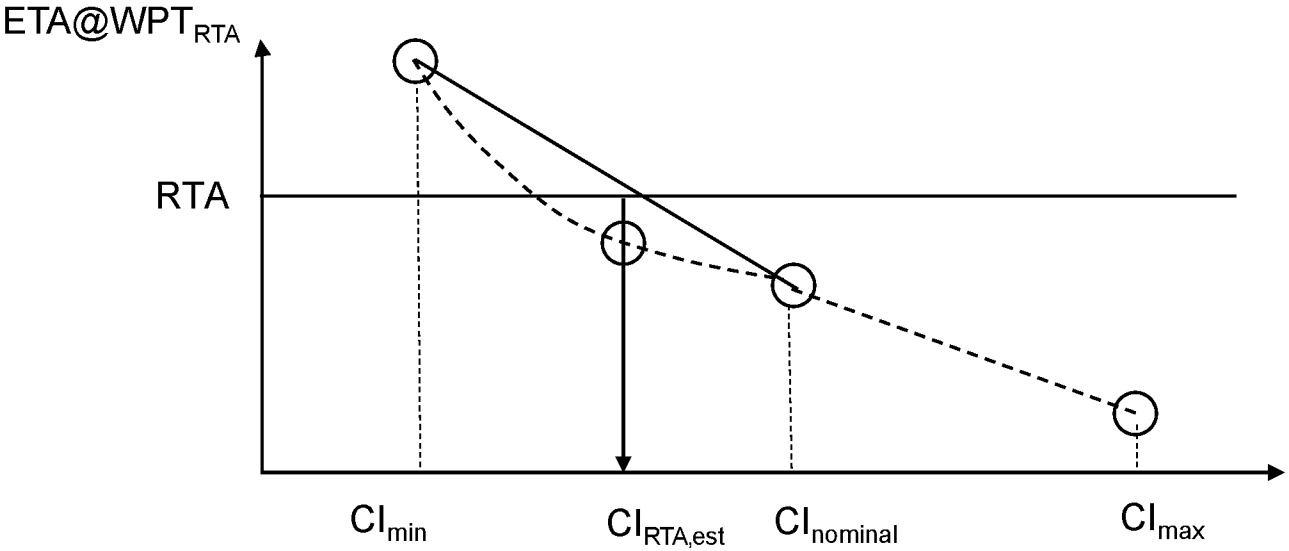
FIG. 5 is a graph showing estimated time-of-arrival at an RTA waypoint versus cost index, which graph may be used to obtain an initial estimate of the RTA cost index in the method for performing cruise optimization disclosed herein.

An even better approximation for $CI_{RTA,est}$ can be obtained by using the current cost index $CI_{nominal}$ and the current $ETA_{nominal}$ if available:

$$CI_{RTA,est}=CI_{lim}-(RTA-ETA_{lim})\times(CI_{lim}-CI_{nominal})/(ETA_{nominal}-ETA_{lim}) \quad (2)$$

where the subscript "lim" indicates the limiting condition: $CI_{max}$ and corresponding earliest $ETA_{fast}$, or $CI_{min}$ and corresponding latest $ETA_{slow}$, depending on whether the RTA is earlier or later than $ETA_{nominal}$, respectively. This linear search is illustrated in FIG. 5, which is a graph showing estimated time-of-arrival at an RTA waypoint versus cost index. This graph may be used to obtain an initial estimate of the RTA cost index in the method for performing cruise optimization disclosed herein. The dashed line in FIG. 5 represents the solution space of ETAs at the RTA waypoint for the entire cost index range where for each cost index, its own optimized vertical profile is applied. Since the locations and candidate altitudes are discretized, this solution space in practice will have a limited number of small discontinuities/jumps in ETA.

Equation (1) describes the linear interpolation of the lookup table with only two break points. Equation (2) is the version with three breakpoints. More breakpoints may be used to more accurately cover the full CI-ETA curve. The more general case for the linear interpolation equations may be expressed as follows:

$$CI_{RTA,est}=CI_{bp_up}-(RTA-ETA_{bp_dn})\times(CI_{bp_up}-CI_{bp_dn})/(ETA_{bp_dn}-ETA_{bp_up})$$

where the subscript "bp_up" indicates the upper breakpoint and the subscript "bp-dn" indicates the lower breakpoint.

The FMC 12 is further configured to calculate the optimum vertical profile for $CI_{RTA,est}$ (step 88 in FIG. 4C). The resulting trajectory approaches the RTA at the target waypoint, but does not yet match. The FMC 12 is further configured to calculate an ETA window $ETA_{window,new}$ for the optimum cruise vertical profile found in step 88 (step 89) and then determine whether the RTA is outside of $ETA_{window,new}$ (step 90). If a determination is made in step 90 that the RTA is outside of $ETA_{window,new}$, then step 86 is repeated with the attempted cost index $CI_{RTA,est}$ as an extra breakpoint in the lookup table.

If a determination is made in step 90 that the RTA is not outside of $ETA_{window,new}$, the FMC 12 performs a search iteration on the cost index involving a trajectory prediction comprising the optimum vertical profile for the cost index $CI_{RTA,est}$, resulting in the precise cost index $CI_{RTA}$ to meet the RTA at a down-path waypoint along the current flight path (step 91). The cruise vertical profile is no longer altered at this stage. As previously disclosed, a Regula Falsi algorithm with Illinois variant may be used to perform the cost index search. After the cost index search, the FMC 12 then calculates the optimum RTA trajectory based on the found cost index $CI_{RTA}$ (step 92). In this embodiment, the FMC 12 controls the speed schedule of the aircraft by altering the cost index of the flight to meet the RTA, but other methods to alter speeds are possible. For example, the cost index during cruise and during descent may be decoupled as disclosed in U.S. Pat. No. 9,213,335. The final solution becomes the new RTA trajectory and the associated speeds are automatically commanded to the aircraft.

Returning briefly to FIG. 4B, if a determination is made in step 84 that the RTA is outside of the window $ETA_{windowOptim}$ (the RTA is not achievable), the FMC 12 is configured to find a new and "degraded" optimum vertical profile having a wider ETA window that enables the RTA to be achieved (step 94). One solution is to fly the aircraft at a constant flight level, which, based on experiments performed, has a much wider ETA window under most conditions. However the constant-flight-level (constant-altitude) solution can become much more expensive in terms of fuel, especially for long-range RTA operations. A more subtle approach is to look for an intermediate solution where the cruise vertical profile is partly flattened (meaning that one or more planned step climbs are removed from the planned flight trajectory) to achieve the RTA with minimal increase in fuel cost. This method is explained in further detail below.

The FMC 12 is further configured to calculate an ETA window $ETA_{window,new}$ for the degraded optimum cruise vertical profile found in step 94 (step 95) and then determine whether the RTA is outside of $ETA_{window,new}$ (step 96). If a determination is made in step 96 that the RTA is not outside of $ETA_{window,new}$, then the FMC 12 performs a search iteration on the cost index involving a trajectory prediction comprising the degraded optimum vertical profile, resulting in the precise new cost index $CI_{RTA,new}$ to meet the RTA at a down-path waypoint along the current flight path for the degraded cruise vertical profile (step 97). Then the FMC 12 calculates the degraded optimum RTA trajectory based on the new cost index $CI_{RTA,new}$ (step 98). If a determination is made in step 96 that the RTA is outside of $ETA_{window,new}$, the fastest or slowest trajectory is selected and an "RTA Unable" message will be generated by the FMC 12 (step 99). The final solution becomes the new RTA trajectory and the associated speeds are automatically commanded to the aircraft by the flight guidance computer 32 (see FIG. 3).

In accordance with a further aspect of the flight management system disclosed herein, while the RTA operation is active, the evolution of the aircraft is periodically monitored. The ETA at the RTA waypoint and ETA window are periodically predicted using latest weather and performance data, for the current RTA speed schedule ($CI_{RTA}$) and cruise vertical profile. If the RTA error (ETA-RTA deviation) is within desired margins, no action is taken. However, if the RTA error is beyond desired margins, a new cost index is found.

Figure 6B:
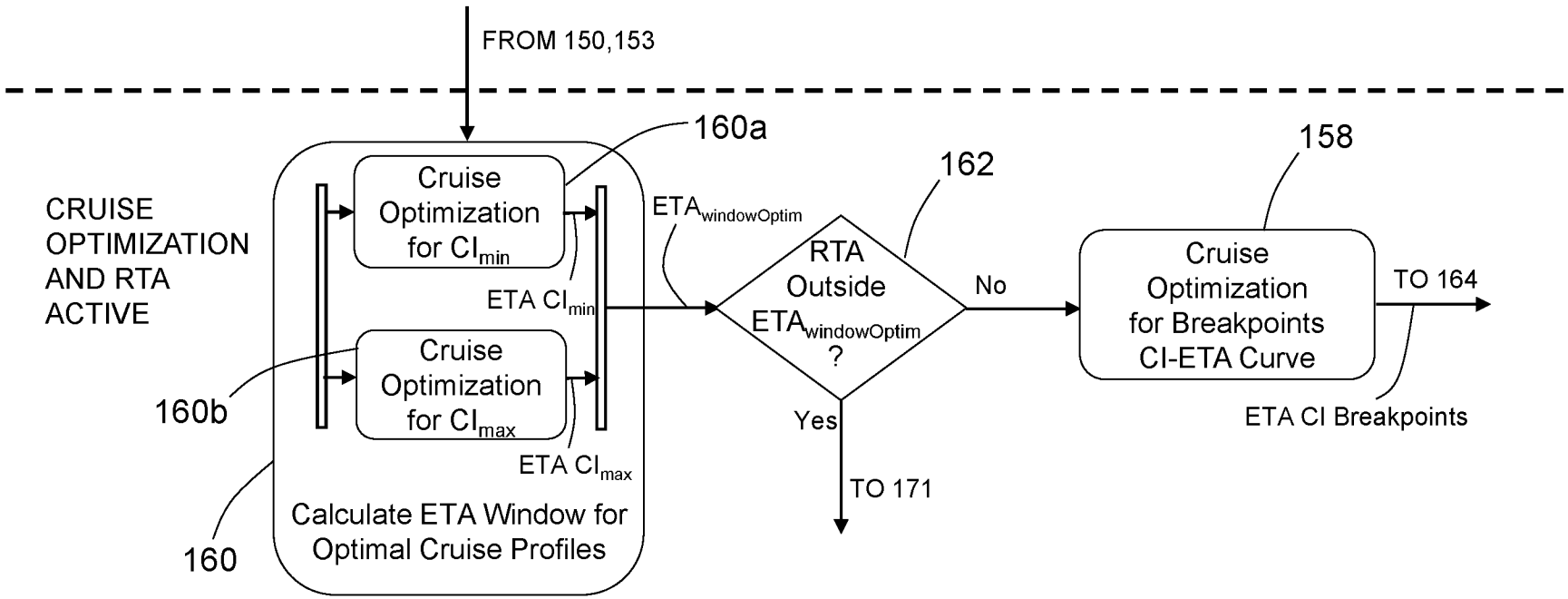
Figure 6C:
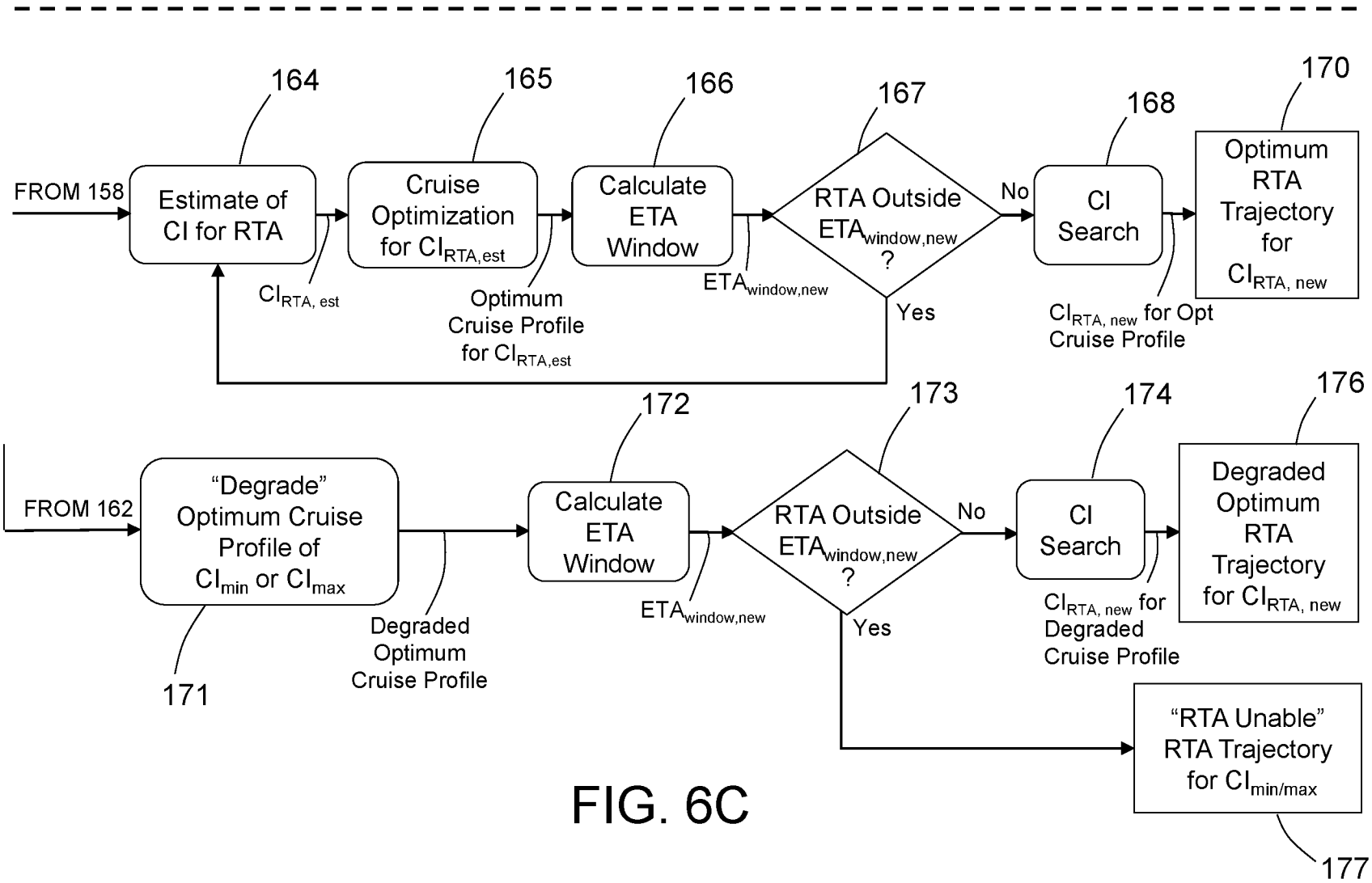

Viewed in conjunction, FIGS. 6A-6C form a flowchart showing the logic of an algorithm 130 for monitoring the RTA trajectory while the RTA speed mode is active with or without cruise optimization. FIG. 6 is a diagram indicating the relationships between FIGS. 6A, 6B and 6C, which appear on separate pages.

Referring the FIG. 6A, the FMC 12 is configured (e.g., programmed) to initially manage a planned trajectory in accordance with an RTA cost index ($CI_{RTA}$) (step 132 in FIG. 6A). The FMC 12 is further configured to retrieve from a non-transitory tangible computer-readable storage medium digital data representing pre-stored margins (referred to herein as a "funnel") which define the allowable deviation of the ETA from the RTA (hereinafter "RTA error") and then periodically compare those desired margins to the RTA error. This periodic check is referred to in FIG. 6A as a funnel check 134.

In step 136, the FMC 12 determines whether the RTA error is outside the funnel or not. If a determination is made in step 136 that the RTA error is not outside the funnel, then the FMC 12 continues to manage the planned RTA trajectory in accordance with the RTA cost index $CI_{RTA}$ (step 138). If a determination is made in step 136 that the RTA error is outside the funnel, then a new cost index $CI_{RTA,new}$ is found. Once outside of the funnel, a new RTA trajectory is determined whether the cruise optimization is active or not.

Still referring to FIG. 6A, the FMC 12 is further configured to make a determination whether the cruise optimization function is active or not (step 140). If a determination is made in step 140 that the cruise optimization function is not active, then the FMC 12 computes the window of achievable estimated times of arrival ($ETA_{window,new}$) (step 142). In the next step (not shown in FIG. 6), the FMC 12 uses the ETA window to determine whether the new RTA is outside the ETA window (meaning that the new RTA is not achievable). If the new RTA is not outside the ETA window, the FMC 12 performs a search iteration on the cost index involving the trajectory prediction, resulting in the precise cost index $CI_{RTA,new}$ to meet the new RTA at a down-path waypoint along the current flight path (step 144). The FMC 12 then calculates the planned trajectory in accordance with the cost index $CI_{RTA,new}$ (step 146). If the RTA is outside the ETA window, the fastest or slowest trajectory is selected and an "RTA unable" message will be generated by the FMC 12, as previously described with reference to FIG. 4A.

If a determination is made in step 140 that the cruise optimization function is active, then the FMC 12 calculates a new cruise vertical profile, but only if that new cruise vertical profile would significantly improve the efficiency of the operation or if the RTA becomes unachievable (outside of the ETA window). Updating the vertical profile if only a small change in cost index is expected may lead to instability in the RTA trajectory search, and as a result may even cause fuel consumption to increase.

First, the FMC 12 estimates the change in cost index ($\Delta CI_{est}$) that would be needed to achieve the RTA as compared to the current cost index $CI_{ETA}$ for the current ETA (step 148). The FMC 12 is further configured to decide to fly the aircraft in accordance with new cost index or not. The decision to fly the aircraft according to the recalculated cruise vertical profile for fuel efficiency purposes can be made by defining a minimum threshold for expected change in cost index $\Delta CI_{est}$ to meet the RTA. This expected change $\Delta CI_{est}$ in RTA cost index is determined using a formula similar to Eq. (2), but using the cost index for the RTA ($CI_{RTA}$) and the estimated cost index for the current ETA ($CI_{ETA,est}$):

$$\Delta CI_{est}=CI_{RTA}-CI_{ETA,est} \quad (3)$$

where $$CI_{ETA,est}=CI_{lim}-(ETA-ETA_{lim})\times(CI_{lim}-CI_{RTA})/(ETA_{nominal}-ETA_{lim}) \quad (4)$$

The more general case for these linear interpolation equations may be expressed as follows:

$$CI_{ETA,est}=CI_{bp_up}-(ETA-ETA_{bp_dn})\times(CI_{bp_up}-CI_{bp_dn})/(ETA_{bp_dn}-ETA_{bp_up})$$

The FMC 12 is configured to determine whether the expected change in cost index $\Delta CI_{est}$ is greater than the specified threshold or not (step 150). If a determination is made in step 150 that the expected change in cost index $\Delta CI_{est}$ is not greater than the specified threshold, then at this stage the FMC 12 keeps the steps for the previously calculated optimum cruise vertical profile. If the cost index is not expected to change much to realign with the RTA ($\Delta CI_{RTA}$ is not greater than the specified threshold), it is best to skip additional cruise optimization to avoid instability in the RTA solution and just freeze the previously calculated cruise steps. The FMC 12 is further configured to execute the following steps: calculate the ETA window (step 152); determine whether the RTA is outside the ETA window or not (step 153); if the RTA is not outside the ETA window, perform an RTA CI search along that frozen cruise vertical profile for a cost index $CI_{RTA,new}$ having an associated airspeed that meets the RTA (step 154); and then calculate an optimum RTA trajectory based on the $CI_{RTA,new}$ while maintaining the previously calculated optimum cruise vertical profile. Note that for the next periodic RTA monitoring action, the expected change in cost index $\Delta CI_{est}$ has to be determined with respect to the CI for which the active optimum cruise vertical profile was calculated, so $CI_{RTA}$ and not $CI_{RTA,new}$.

If a determination is made in step 150 that the expected change in cost index $\Delta CI_{est}$ is greater than the specified threshold, then the FMC 12 is further configured to execute a cruise optimization routine (part of algorithm 130) that calculates a new optimum cruise vertical profile. Similarly, if a determination is made in step 153 that the RTA is outside the ETA window, then the FMC 12 executes the same cruise optimization routine to calculate a new near-optimum cruise vertical profile.

Referring to FIG. 6B, the FMC 12 calculates the window of achievable ETAs for a set of optimum vertical profiles (step 160). This ETA window is calculated considering the slowest and fastest trajectories, both optimized vertically for their respective minimum and maximum cost indexes $CI_{max}$ and $CI_{min}$ (steps 160*a* and 160*b* respectively). More specifically, the ETA window $ETA_{windowOptim}$ is defined by one ETA corresponding to $CI_{max}$ (hereinafter "ETA $CI_{max}$") and another ETA corresponding to $CI_{min}$ (hereinafter "ETA $CI_{max}$"). The FMC 12 then uses the window $ETA_{windowOptim}$ to determine whether the RTA is outside of the window $ETA_{windowOptim}$ (meaning that the RTA is out of the reach of an optimized cruise trajectory) or not (step 162).

Still referring to FIG. 6B, the FMC 12 is further configured to then determine the cruise vertical profile for the RTA operation, with near-optimal fuel cost to the extent possible. If a determination is made in step 162 that the RTA is not outside of the window $ETA_{windowOptim}$ (the RTA is achievable), the FMC 12 seeks an optimum vertical profile for the RTA trajectory. Estimation of the CI for the RTA is based on a linear lookup table of CI versus ETA. The number of breakpoints in the lookup table includes at least the limit values $CI_{min}$ and $CI_{max}$ for the ETA window and the nominal cost index $CI_{nominal}$, and can be extended with any number of predefined cost indexes to better capture the shape of the CI versus ETA curve. Cruise optimization is performed for the additional cost index breakpoints in step 158.

Following step 158, the algorithm 130 proceeds to step 164 depicted in FIG. 6C. The FMC 12 first calculates an initial best estimate of the RTA cost index $CI_{RTA,est}$ (step 164 in FIG. 6C). The resulting estimated cost index $CI_{RTA,est}$ is not accurate enough to be used for the RTA trajectory directly, but it is sufficiently close to determine the optimum vertical profile for an RTA operation with near-optimal cost.

The FMC 12 is further configured to calculate the optimum vertical profile for $CI_{RTA,est}$ (step 165 in FIG. 6C). The resulting trajectory approaches the RTA at the target waypoint, but does not yet match. The FMC 12 is further configured to calculate an ETA window $ETA_{window,new}$ for the optimum cruise vertical profile found in step 165 (step 166) and then determine whether the RTA is outside of $ETA_{window,new}$ (step 167). If a determination is made in step 167 that the RTA is outside of $ETA_{window,new}$, then step 164 is repeated with the attempted cost index $CI_{RTA,est}$ as an extra breakpoint in the lookup table.

If a determination is made in step 167 that the RTA is not outside of $ETA_{window,new}$, the FMC 12 performs a search iteration on the cost index involving a trajectory prediction comprising the optimum vertical profile for $CI_{RTA,est}$, resulting in the precise cost index $CI_{RTA}$ to meet the RTA at a down-path waypoint along the current flight path (step 168). The cruise vertical profile is no longer altered at this stage. As previously described, the Regula Falsi algorithm with Illinois variant (an algorithm similar to the root-finding Newton or Secant method) is used to perform the cost index search. The FMC 12 then calculates the optimum RTA trajectory based on the new cost index $CI_{RTA,new}$ (step 170). The FMC 12 controls the speed schedule of the aircraft by altering the cost index of the flight to meet the RTA, but other methods to alter speeds are possible. The final solution becomes the new RTA trajectory and the associated speeds are automatically commanded to the aircraft.

Returning briefly to FIG. 6B, if a determination is made in step 162 that the RTA is outside of the window $ETA_{windowOptim}$ (the RTA is not achievable), the FMC 12 is configured to find a new and degraded optimum vertical profile having a wider ETA window that enables the RTA to be achieved (step 171). The FMC 12 is further configured to calculate an ETA window $ETA_{window,new}$ for the degraded optimum cruise vertical profile found in step 171 (step 172) and then determine whether the RTA is outside of $ETA_{window,new}$ (step 173). If a determination is made in step 173 that the RTA is not outside of $ETA_{window,new}$, then the FMC 12 performs a search iteration on the cost index involving a trajectory prediction comprising the degraded optimum vertical profile, resulting in the precise new cost index $CI_{RTA,new}$ to meet the RTA at a down-path waypoint along the current flight path for the degraded cruise vertical profile (step 174). Then the FMC 12 calculates the degraded optimum RTA trajectory based on the new cost index $CI_{RTA,new}$ (step 176). If a determination is made in step 173 that the RTA is outside of $ETA_{window,new}$, the fastest or slowest trajectory is selected and an "RTA Unable" message will be generated by the FMC 12 (step 177).

In accordance with one aspect of the computer functionality disclosed herein, an optimum vertical profile may be degraded to achieve a required time-of-arrival. When an RTA is not achievable along the optimum vertical profile, the simplest solution would be to maintain a constant cruise vertical profile and avoid any vertical profile optimization. Flying at a lower constant altitude during cruise always provides a much greater window for the aircraft to arrive at a later time (permits flying at much slower speeds). Flying at a lower constant altitude during cruise also typically provides more margin to fly at higher speeds (due to the performance speed envelope) and therefore to arrive earlier as well, although the gained time margin here is usually much smaller (if existent). The drawback of switching from an optimized vertical profile directly to constant altitude is that such a switch entails a high fuel consumption penalty.

There are intermediate vertical profiles that can be constructed when the RTA and the vertical profile construction functionalities are integrated in the same function. The starting point is the optimized vertical profile for the applicable limiting cost index (i.e., the minimum cost index if the RTA is earlier than the achievable ETA window). One potential solution strategy to degrade this optimized vertical profile involves the following operations:

(1) Gradually slide the top climb step in a down-path direction, that is, toward the end of the cruise. As the top cruise section becomes shorter in distance, the latest ETA achievable becomes further delayed; the earliest ETA may also become further advanced.

(2) When the climb step is sufficiently close to the end of the cruise, remove it entirely.

(3) If dealing with a descent step, then slide the descent step in the up-path direction until it collapses with a climb step or reaches the current position.

(4) If more ETA margin is required, proceed to slide the next lower step toward the end of cruise (or descent step toward the prior climb step or current position).

(5) If the foregoing operations were performed for all steps in the cruise vertical profile, the result would be a constant-altitude profile which has the widest window of achievable ETAs, but also carries the greatest fuel penalization.

Figure 7A:
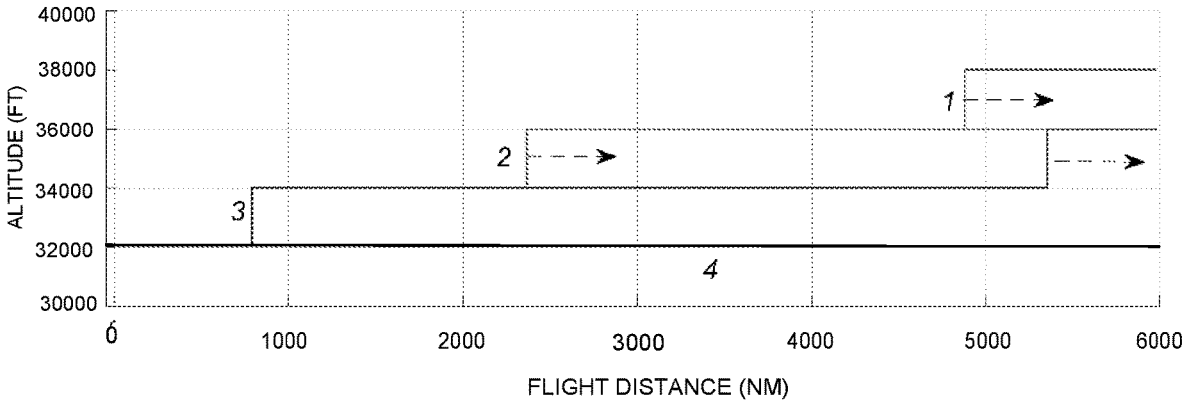
FIG. 7A is a graph showing altitude versus flight distance for some example cruise vertical profiles that may be constructed according to the method, based on representative aircraft simulations for a cost index CI=0, that is, slow trajectories that produce late ETAs. The example cruise vertical profiles include an optimum cruise vertical profile #1, two less-than-optimum cruise vertical profiles #2 and #3, and a constant-flight level cruise vertical profile #4.

FIG. 7A illustrates some example intermediate vertical profiles that can be constructed according to the method explained above, based on representative simulations for zero cost index, that is, slow trajectories that produce late ETAs. FIG. 7A is a graph showing altitude versus flight distance for four cruise vertical profiles at a cost index CI=0, including an optimum cruise vertical profile #1, two less-than-optimum cruise vertical profiles #2 and #3, and a constant-flight level cruise vertical profile #4.

Figure 7B:
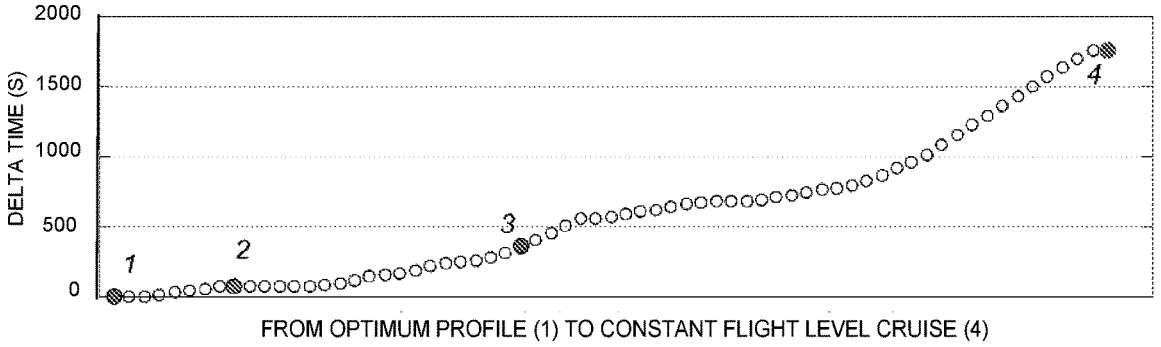
FIG. 7B is a graph showing delay of arrival times (ΔTime, in seconds) at the end of a simulated cruise phase with respect to the optimum cruise vertical profile #1 (shown in FIG. 7A).
Figure 7C:
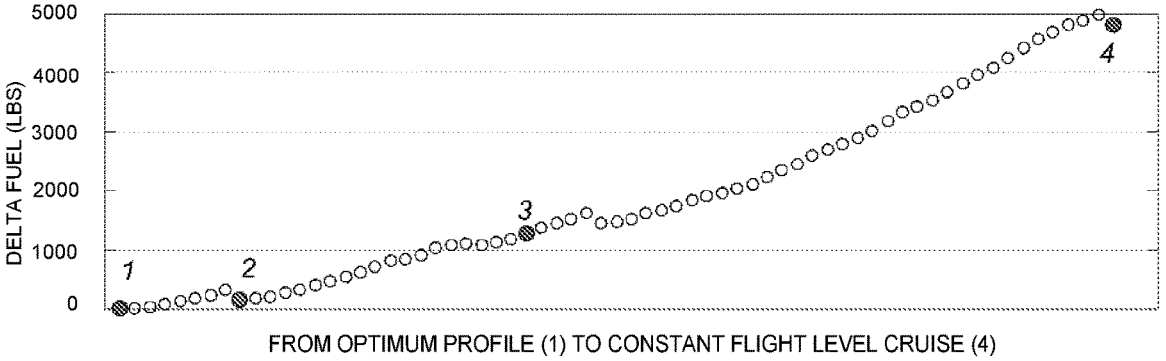
FIG. 7C is a graph showing increase in fuel cost (ΔFuel, in lbs) at the end of a simulated cruise phase with respect to the optimum cruise vertical profile #1 (shown in FIG. 7A).

FIG. 7B is a graph showing the delay of arrival times (ΔTime, in seconds) at the end of the cruise phase for respective alternative simulated cruise vertical profiles and for the optimum cruise vertical Profile #1 (shown in FIG. 7A) generated during a simulation. FIG. 7C is a graph showing the increase in fuel cost (ΔFuel, in lbs.) at the end of the cruise phase for respective alternative simulated cruise vertical profiles and for the optimum cruise vertical profile #1 (shown in FIG. 7A) generated during the same simulation that produced the data shown in FIG. 7B. The profile that allows for a greater margin of extra delay is the constant-altitude Profile #4, which achieves almost half an hour of delay. The expense, however, of flying with the constant-altitude profile is almost 5000 lbs. of fuel.

Figure 8A:
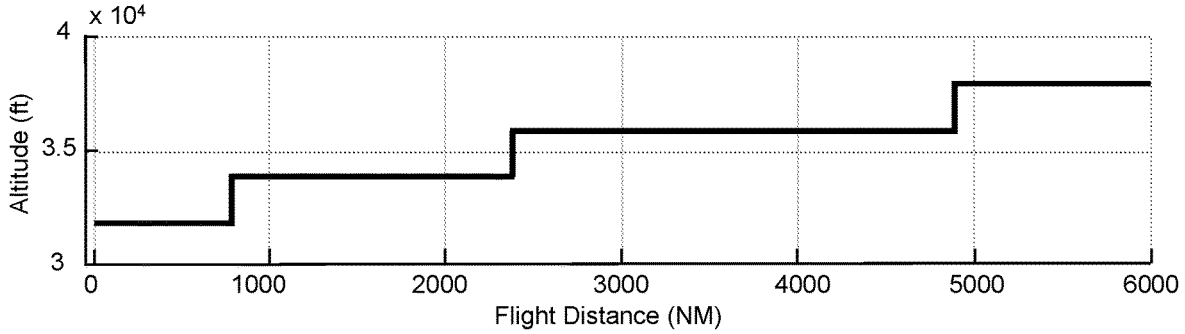
FIGS. 8A-8D are graphs showing altitude versus flight distance for respective example cruise vertical profiles, including an optimum cruise vertical profile having first, second and third step climbs (FIG. 8A), a cruise vertical profile having the first and second step climbs, but not the third step climb (FIG. 8B), a cruise vertical profile having the first step climb only (FIG. 8C), and a constant-flight-level cruise vertical profile having no step climbs (FIG. 8D).
Figure 8B:
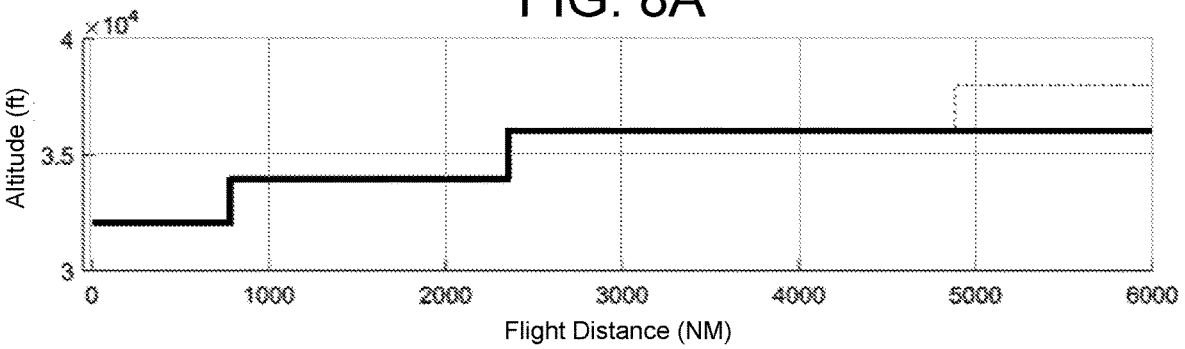
Figure 8C:
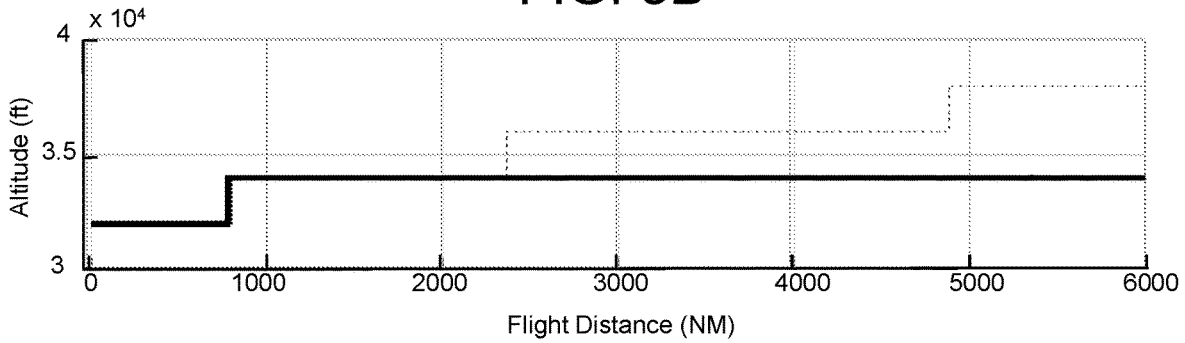
Figure 8D:
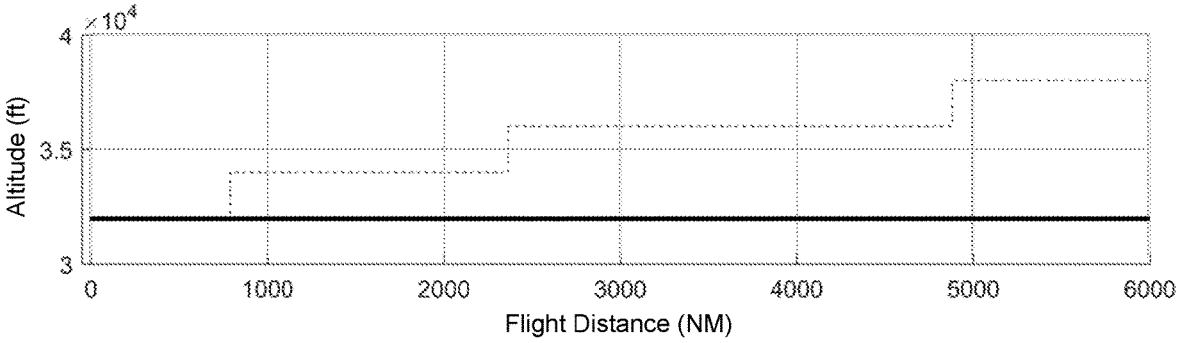

FIGS. 8A-8D are graphs showing altitude versus flight distance for respective example cruise vertical profiles, including an optimum cruise vertical profile having first, second and third step climbs (FIG. 8A), a cruise vertical profile having the first and second step climbs, but not the third step climb (FIG. 8B), a cruise vertical profile having the first step climb only (FIG. 8C), and a constant-flight-level cruise vertical profile having no step climbs (FIG. 8D).

The graphs in FIGS. 8A-8D represent four profiles from a simulation. The first profile shown in FIG. 8A has three optimum cruise steps (hereinafter "Profile #1"); the second profile shown in FIG. 8B is the result of removing the highest step closest to the top of descent (hereinafter "Profile #2"); the third profile shown in FIG. 8C is the result of removing another step (hereinafter "Profile #3"); and the fourth profile shown in FIG. 8D is the result of removing all steps (constant flight level) (hereinafter "Profile #4").

Referring to FIG. 8B, if the pilot were to fly the aircraft along Profile #2, an extra 75 seconds of delay margin may be achieved if the pilot wants to reach the destination at a later time. This margin is achieved flying at the slowest possible speeds, which are even slower when flying along Profile #2 than when flying along Profile #1. The pilot may use these 75 seconds of extra delay to meet an RTA which, if the aircraft were flying along Profile #1, would have been impossible to achieve. The trade-off is that up to 150 lbs. of extra fuel will be burnt as a consequence of using a vertical profile that is not the optimum anymore.

Referring to FIG. 8C, if the pilot were to fly the aircraft along Profile #3, an extra 360 seconds of delay may be achieved as compared to Profile #1 because the aircraft may fly even slower within the speed margins. However, up to 1275 lbs. of extra fuel will be burnt as a consequence of flying at lower altitudes than the altitudes (depicted in FIG. 8A) of the original optimized Profile #1.

Referring to FIG. 8D, if the pilot were to fly the aircraft along Profile #4 (constant flight level), the pilot may achieve up to 1800 seconds of delay, but at the expense of up to 4813 lbs. of extra fuel. At much lower altitude, the aircraft can fly significantly slower, but at the expense of a large amount of fuel, because commercial aircraft engines are much more efficient at higher altitudes.

In practice, the above solution strategy may be implemented with the following iterative method: It is not practical to plot ETAs with many intermediate solutions and then look for the ETA that is needed by inspection. Instead, an iterative algorithm can be used in order to search for the best intermediate profile that meets the required time-of-arrival. The idea consists of mapping any intermediate solution to a single variable, by accumulating the displacement of steps: X=sum(distance of climb step displaced toward end of descent)+sum(distance of descent step displaced toward prior climb step or current position). There is a one-to-one correspondence between the variable X and any intermediate vertical profile. A root-finding method (such as the Regula Falsi algorithm) for $ETA_{max}(X)=RTA$ will provide the first profile that can provide a sufficient extra delay in its slowest trajectory in order to achieve the required time-of-arrival. In the same manner, if the RTA requires an anticipation that the optimized vertical cruise cannot permit, then a root-finding algorithm for $ETA_{min}(X)=RTA$ will provide the first profile that can achieve the required time-of-arrival.

Also more advanced variants of the above solution strategy are possible. For example, first slide the step climb that brings the most change in ETA for the smallest fuel penalty, and then proceed to slide the rest of the step climbs, in order of increasing impact on fuel penalty.

Additionally, other variants can be applied if a simplified algorithm is needed, such as: (1) construct the intermediate solutions as simultaneous displacements of all steps, gradually and proportionally, to converge to the constant-altitude profile, instead of step by step as described above; or (2) flatten every step without sliding the step, making them disappear one by one. This alternative provides only very few intermediate profiles (in our case, two intermediate solutions only), but its implementation is trivial. Further variants can be applied.

The aircraft can also achieve wider margins of anticipation as it flight level is lowered, so the same reasoning can be applied for flying lower and faster at the cost of much higher fuel burn. However, the typical margins of anticipation gains are much smaller than the margins of delay. Furthermore, with the influence of variable winds, these gains of anticipation may easily disappear.

In any case, since air traffic control frequently mandates that specified delays be achieved (for instance, it is more probable that air traffic control demands a delay to arrive to a congested or a severe weather-affected airport, than an anticipation), the use of lower altitudes to achieve a required time-of-arrival is justified.

In summary of the above-discussed simulation results, if the aircraft is able to achieve the RTA within the ETA margins imposed by speed limitations, the pilot may fly the aircraft along Profile #1. If an extra delay from 0 to 75 seconds is desired, then that constraint may be achieved at minimum speeds along Profile #1, in which case the flight management system may remove the step closest to the top of descent and use that profile to search for the RTA speeds (Profile #2). If an extra delay from 75 to 360 seconds is desired, then that that constraint may be achieved at minimum speeds over Profile #1, in which case the flight management system may remove the two steps closest to the top of descent and use the resulting profile to search for the RTA speeds (Profile #3). Lastly, if an extra delay from 360 to 1800 seconds is desired, then that constraint may be achieved by flying the aircraft at a constant level (without steps) at the cost of much higher fuel consumption. If an extra delay of more than 1800 seconds is desired, then the aircraft cannot meet the RTA (using this method).

Also, when the FMC 12 calculates the optimum profile, the computer may compute the minimum and maximum times and corresponding costs of flying at many different cruise levels. Therefore, it is relatively easy and computationally inexpensive (if this calculation is done in an approximate manner) to search for the best location of the steps (in altitude) in order to meet a particular delay or anticipation. Based on the continuous curves of delta time and extra fuel consumption (represented by circles) shown in FIGS. 7B and 7C, a table may be created with the minimum/maximum time achievables and the extra fuel consumptions as the algorithm displaces one step at a time toward the top of descent (these are the curves that were represented by circles in the invention disclosure). By simply searching a lookup table, the locations of the steps (in altitude) that produce the desired delay with minimum fuel consumption may be identified. This solution permits finding the profile that provides the necessary extra margin of time while keeping the increase of flight cost as limited as possible.

The above-described method will be implemented as software running on the FMC 12 or a similar electronic data processing device that can access the required data to perform the calculations. In accordance with one embodiment, the new functionality disclosed herein resides in the FMC 12 in the form of an executable algorithm that includes the steps described above. The method takes into account the up-to-date route data, best available aircraft weight estimates, and best available wind and temperature predictions (including actual wind/temperature and blended wind/temperature).

Figure 9:
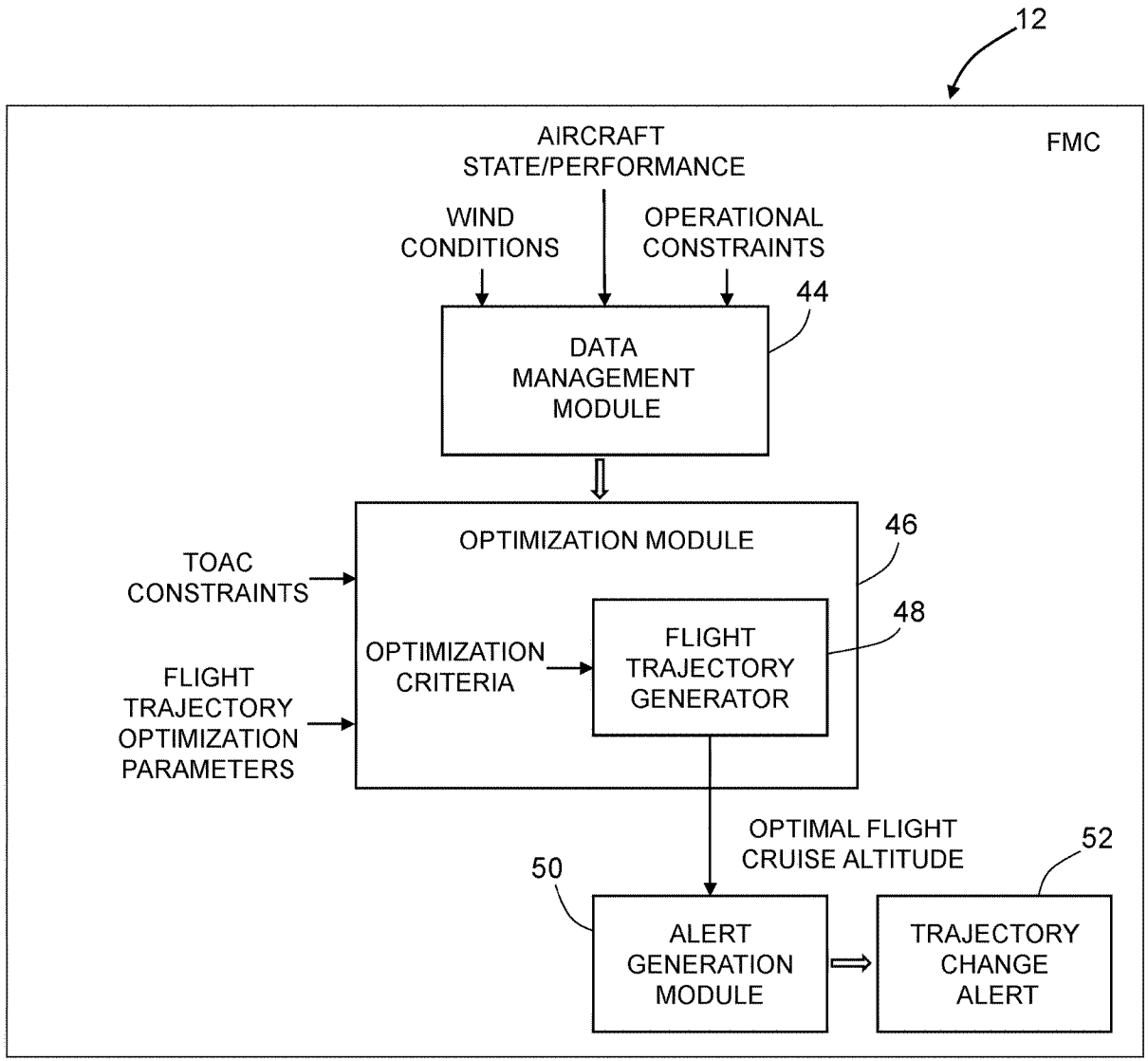
FIG. 9 is a block diagram identifying various software modules inside a flight management computer programmed to perform the cruise optimization with RTA constraint function proposed herein.

FIG. 9 is a block diagram identifying various software modules inside a FMC 12 programmed to generate a flight trajectory using the cruise optimization with RTA constraint function proposed herein. The flight management computer 12 includes a data management module 44 for receiving atmospheric conditions (real-time and/or forecasted, and preferably including wind conditions) about an aircraft route. The data management module 44 also receives data on aircraft operational constraints and real-time aircraft state and performance (e.g., from the baseline performance database 30 identified in FIG. 2).

The FMC 12 also includes an optimization module 46 which can be implemented, for instance, in a processor and a non-transitory tangible computer-readable storage medium. The optimization module 46 receives the data retrieved from the data management module 44, the time-of-arrival control (TOAC) constraints and one or more flight trajectory optimization parameters. The optimization parameters include at least cruise altitude and may also include aircraft airspeed. The TOAC constraints normally comprise a RTA for at least one waypoint in the flight plan. The RTA can be set by the pilot using a CDU 14 or other input device (for instance, a touchscreen). The optimization parameters can be pre-established and stored in a non-transitory tangible computer-readable storage medium of the FMC 12 or can be also selected by the pilot using the means for inputting data.

The optimization module 46 comprises a flight trajectory generator 48 that generates a plurality of set of values for one or more flight trajectory optimization parameters, so that all the generated set of values include cruise altitudes different from the current aircraft altitude. For instance, if the optimization parameters include cruise altitude and aircraft airspeed, the generated values are pairs of (altitude, speed) values in which the altitude is different from the current aircraft altitude. The flight trajectory generator 48 computes, for the generated set of values of the flight trajectory optimization parameters, flight trajectories of the aircraft taking into account the received atmospheric conditions and the data on aircraft operational constraints and real-time aircraft state and performance.

The flight trajectory generator 48 uses a cost function to select, based on one or more optimization criteria, one or more optimum cruise altitudes with a computed flight trajectory complying with the time-of-arrival constraint. The optimization criteria may comprise fuel saving, speed control margin and/or time control margin.

The FMC 12 also includes an alert generation module 50 that generates a trajectory change alert 52 with the one or more selected optimum cruise altitudes. The alert generation module 50 may, for instance, display on a screen of a cockpit graphical display system 15 the trajectory change alert 52, pointing out the alternative optimum cruise altitudes for which fuel saving or an improvement in robustness of the TOAC is achieved and the potential corresponding benefits (e.g., 250 kg fuel savings expected for new altitude). The pilot will then decide whether to accept or not any of the proposed flight trajectories with different cruise altitudes and, optionally, different aircraft airspeed.

One of the significant benefits of the proposed invention is the capability to advise the pilots if any saving opportunity may arise during an ongoing RTA operation as atmospheric conditions change. For this purpose, the optimization module 46 of the FMC 12 will continuously iterate on the RTA constraint, both in the speed and altitude domains, taking into account current wind profiles, operational constraints and real-time aircraft status to determine if a more efficient trajectory could be established. In that case the pilots are duly notified, and decide whether to follow the recommended flight trajectory or not. Thus the technology disclosed herein may ensure that the pilots become aware of potential saving opportunities during RTA operations.

While systems and methods for planning and flying a cost-optimal cruise vertical profile in combination with a RTA constraint have been described with reference to various embodiments, it will be understood by those skilled in the art that various changes may be made and equivalents may be substituted for elements thereof without departing from the scope of the teachings herein. In addition, many modifications may be made to adapt the teachings herein to a particular situation without departing from the scope thereof. Therefore it is intended that the claims not be limited to the particular embodiments disclosed herein.

The methods described herein may be encoded as executable instructions embodied in a non-transitory tangible computer-readable storage medium, including, without limitation, a storage device and/or a memory device. Such instructions, when executed by a processing or computing system, cause the system device to perform at least a portion of the methods described herein. The embodiments described in some detail above may include computer-executable instructions, such as routines executed by a programmable computer. Other computer system configurations may be employed, such as a special-purpose computer or a data processor that is specifically programmed, configured, or constructed to perform one or more of the computer-executable instructions described below. Accordingly, the term "computer" as generally used herein refers to any data processor that can be engaged in a cockpit, including computers for cockpit display systems, flight management computers, flight control computers, electronic flight bags, laptops, laptops, or other hand-held devices.

The process claims set forth hereinafter should not be construed to require that the steps recited therein be performed in alphabetical order (any alphabetical ordering in the claims is used solely for the purpose of referencing previously recited steps) or in the order in which they are recited unless the claim language explicitly specifies or states conditions indicating a particular order in which some or all of those steps are performed. Nor should the process claims be construed to exclude any portions of two or more steps being performed concurrently or alternatingly unless the claim language explicitly states a condition that precludes such an interpretation.

The invention claimed is:

1. A method for flying an aircraft along a trajectory subject to time-of-arrival constraints during a cruise phase, the method comprising:

(a) determining an optimum trajectory that includes a speed schedule that meets a required time-of-arrival at a waypoint and a vertical profile that optimizes fuel efficiency; and (b) flying the aircraft along the optimum trajectory determined in step (a) during the cruise phase, wherein step (a) is an integrated function executed by a computer, the integrated function consisting of a required time-of-arrival functionality and an optimized cruise step-climb functionality; and wherein step (a) comprises:

determining that a cruise optimization function is active;

operating the aircraft in accordance with an ECON speed mode in which the vertical profile is optimized based on a nominal cost index ($CI_{nominal}$) set by a flight crew;

determining that an RTA speed mode is active;

determining a first optimum vertical profile for a maximum cost index in response to a determination that the RTA speed mode is active;

calculating a first estimated time-of-arrival for the first optimum vertical profile;

determining a second optimum vertical profile for a minimum cost index in response to a determination that the RTA speed mode is active;

calculating a second estimated time-of-arrival for the second optimum vertical profile;

determining that the required time-of-arrival is not outside of a first estimated time-of-arrival window bounded by the first and second estimated times-of-arrival;

estimating a first cost index ($CI_{RTA,est}$) for the required time-of-arrival;

determining an optimum vertical profile for the first cost index;

calculating a second estimated time-of-arrival window for the optimum vertical profile;

determining that the required time-of-arrival is not outside of the second estimated time-of-arrival window;

performing a cost index search iteration involving a trajectory prediction comprising the optimum vertical profile for the first cost index, resulting in a second cost index ($CI_{RTA}$) that produces an estimated time-of-arrival that meets the required time-of-arrival for flight along the optimum vertical profile; and calculating the optimum trajectory based on the second cost index.

2. The method as recited in claim 1, wherein a required time-of-arrival (RTA) speed mode and cruise optimization are both active when step (a) is performed and the vertical profile of the optimum trajectory determined in step (a) increases the fuel efficiency during step (b) as compared to the fuel efficiency prior to step (b).

3. The method as recited in claim 1, wherein the computer is a flight management computer onboard the aircraft.

4. The method as recited in claim 1, wherein determining the optimum trajectory comprises determining a location of a step in altitude during the cruise phase that increases fuel efficiency during flight.

5. The method as recited in claim 1, wherein step (b) comprises flying the aircraft in accordance with the optimum vertical profile.

6. A system for flying an aircraft along a trajectory subject to time-of-arrival constraints during a cruise phase, the system comprising a computer system configured to perform the following operations:

(a) determining an optimum trajectory that includes a speed schedule that meets a required time-of-arrival (RTA) at a waypoint and a vertical profile that optimizes fuel efficiency; and (b) controlling the aircraft to fly along the optimum trajectory determined in step (a) during the cruise phase, wherein the computer system comprises a first computer, operation (a) is an integrated function executed by the first computer, and the integrated function consists of a required time-of-arrival functionality and an optimized cruise step-climb functionality; and wherein the first computer is configured to perform the following operations during operation (a):

determining whether a cruise optimization function is active or not;

determining whether or not an RTA speed mode is active in response to a determination that the cruise optimization function is not active;

maintaining a planned trajectory for a nominal cost index ($CI_{nominal}$) in response to a determination that the RTA speed mode is not active;

computing a window of achievable estimated times of arrival ($ETA_{window}$) in response to a determination that the RTA speed mode is active;

determining that the required time-of-arrival is not outside the window of achievable estimated times of arrival;

calculating an RTA trajectory by performing a search iteration on a cost index involving a trajectory prediction to converge to a precise cost index ($CI_{RTA}$) to meet the required time-of-arrival;

operating the aircraft in accordance with an ECON speed mode in which the vertical profile is optimized based on the nominal cost index set by a flight crew in response to a determination that the cruise optimization function is active;

determining whether or not an RTA speed mode is active in response to a determination that the cruise optimization function is active;

recomputing an optimized trajectory for current flight conditions in accordance with the nominal cost index in response to a determination that the RTA speed mode is not active;

determining a first optimum vertical profile for a maximum cost index in response to a determination that the RTA speed mode is active;

calculating a first estimated time-of-arrival for the first optimum vertical profile;

determining a second optimum vertical profile for a minimum cost index in response to a determination that the RTA speed mode is active;

calculating a second estimated time-of-arrival for the second optimum vertical profile;

determining that the required time-of-arrival is not outside of an estimated time-of-arrival window bounded by the first and second estimated times-of-arrival;

estimating a first cost index ($CI_{RTA,est}$) for the required time-of-arrival;

determining an optimum vertical profile for the first cost index;

calculating an estimated time-of-arrival window for the optimum vertical profile using the maximum cost index and the minimum cost index;

determining that the required time-of-arrival is not outside of the estimated time-of-arrival window;

performing a cost index search iteration involving a trajectory prediction comprising the optimum vertical profile for the first cost index, resulting in a second cost index ($CI_{RTA}$) that produces an estimated time-of-arrival that meets the required time-of-arrival for flight along the optimum vertical profile; and calculating the optimum trajectory based on the second cost index.

7. The system as recited in claim 6, wherein the computer system further comprises a second computer configured to control the aircraft to fly in accordance with the optimum vertical profile.

8. The system as recited in claim 6, wherein an RTA speed mode and cruise optimization are both active when operation (a) is performed and the vertical profile of the optimum trajectory determined in operation (a) is calculated to increase the fuel efficiency during operation (b) as compared to the fuel efficiency prior to operation (b).

9. A method for flying an aircraft along a trajectory subject to time-of-arrival constraints during a cruise phase, the method comprising:

determining that a cruise optimization function is active;

operating the aircraft in accordance with an ECON speed mode in which a vertical profile is optimized based on a nominal cost index ($CI_{nominal}$) set by a flight crew;

determining that an RTA speed mode is active;

determining a first optimum vertical profile for a maximum cost index in response to a determination that the RTA speed mode is active;

calculating a first estimated time-of-arrival for the first optimum vertical profile;

determining a second optimum vertical profile for a minimum cost index in response to a determination that the RTA speed mode is active;

calculating a second estimated time-of-arrival for the second optimum vertical profile;

determining that a required time-of-arrival (RTA) is outside of an estimated time-of-arrival window bounded by the first and second estimated times-of-arrival;

determining a degraded optimum trajectory that includes a speed schedule that meets the required time-of-arrival at a waypoint and a degraded optimum vertical profile that is calculated to improve fuel efficiency as compared to a current fuel efficiency; and flying the aircraft along the degraded optimum trajectory during the cruise phase, wherein determining the degraded optimum trajectory is an integrated function executed by a computer, the integrated function consisting of a required time-of-arrival functionality and an optimized cruise step-climb functionality.

10. The method as recited in claim 9, wherein determining the degraded optimum trajectory comprises determining a location of a step in altitude during the cruise phase that is calculated to improve the fuel efficiency during flight.

11. The method as recited in claim 9, wherein determining the degraded optimum trajectory comprises:

determining a degraded optimum vertical profile for the maximum or minimum cost index;

calculating an estimated time-of-arrival window for the degraded optimum vertical profile;

determining that the required time-of-arrival is not outside of the estimated time-of-arrival window;

performing a cost index search iteration involving a trajectory prediction comprising the degraded optimum vertical profile, resulting in a cost index ($CI_{RTA}$) that meets the required time-of-arrival for flight along the degraded optimum vertical profile; and calculating the degraded optimum trajectory based on the cost index ($CI_{RTA}$).

12. The method as recited in claim 11, wherein flying the aircraft along the degraded optimum trajectory during the cruise phase comprises flying the aircraft in accordance with the degraded optimum vertical profile and the cost index ($CI_{RTA}$).

13. A system for flying an aircraft along a trajectory subject to time-of-arrival constraints during a cruise phase, the system comprising a first computer configured to perform the following operations:

determining whether a cruise optimization function is active or not;

determining whether or not an RTA speed mode is active in response to a determination that the cruise optimization function is not active;

maintaining a planned trajectory for a nominal cost index ($CI_{nominal}$) in response to a determination that the RTA speed mode is not active;

computing a window of achievable estimated times of arrival ($ETA_{window}$) in response to a determination that the RTA speed mode is active;

determining that a required time-of-arrival (RTA) is not outside the window of achievable estimated times of arrival;

calculating an RTA trajectory by performing a search iteration on a cost index involving a trajectory prediction to converge to a precise cost index ($CI_{RTA}$) to meet the required time-of-arrival;

operating the aircraft in accordance with an ECON speed mode in which a vertical profile is optimized based on the nominal cost index set by a flight crew in response to a determination that the cruise optimization function is active;

determining whether or not an RTA speed mode is active in response to a determination that the cruise optimization function is active;

recomputing an optimized trajectory for current flight conditions in accordance with the nominal cost index in response to a determination that the RTA speed mode is not active;

determining a first optimum vertical profile for a maximum cost index in response to a determination that the RTA speed mode is active;

calculating a first estimated time-of-arrival for the first optimum vertical profile;

determining a second optimum vertical profile for a minimum cost index in response to a determination that the RTA speed mode is active;

calculating a second estimated time-of-arrival for the second optimum vertical profile;

determining that the required time-of-arrival is outside of an estimated time-of-arrival window bounded by the first and second estimated times-of-arrival; and determining a degraded optimum trajectory that includes a speed schedule that meets the required time-of-arrival at a waypoint and a degraded optimum vertical profile that is calculated to improve fuel efficiency as compared to a current fuel efficiency; and the system further comprising a second computer configured to control the aircraft to fly along the degraded optimum trajectory during the cruise phase, wherein determining a degraded optimum trajectory is an integrated function consisting of a required time-of-arrival functionality and an optimized cruise step-climb functionality.

14. The system as recited in claim 13, wherein the second computer is configured to control the aircraft to fly in accordance with the degraded optimum vertical profile.

15. The system as recited in claim 13, wherein the first computer is further configured to perform the following operations in response to the required time-of-arrival being outside of the estimated time-of-arrival window:

determining the degraded optimum vertical profile for the maximum or minimum cost index;

calculating a new estimated time-of-arrival window for the degraded optimum vertical profile using the maximum cost index and the minimum cost index;

determining that the required time-of-arrival is not outside of the new estimated time-of-arrival window;

performing a cost index search iteration involving a trajectory prediction comprising the degraded optimum vertical profile, resulting in a cost index ($CI_{RTA}$) that meets the required time-of-arrival for flight along the degraded optimum vertical profile; and calculating the degraded optimum trajectory based on the cost index ($CI_{RTA}$).

16. The system as recited in claim 15, wherein the first computer is further configured to issue a signal indicating that the integrated function is unable to find an optimum trajectory that meets the required time-of-arrival in response to the required time-of-arrival being outside of the new estimated time-of-arrival window.

* * * * *